US009546478B2

(12) United States Patent
Nadeau

(10) Patent No.: US 9,546,478 B2
(45) **Date of Patent: *Jan. 17, 2017**

(54) CONTINUOUS TENSION, DISCONTINUOUS COMPRESSION SYSTEMS AND METHODS

(71) Applicant: Gerard F. Nadeau, Springfield, MO (US)

(72) Inventor: Gerard F. Nadeau, Springfield, MO (US)

( * ) Notice: Subject to any disclaimer, the term of this patent is extended or adjusted under 35 U.S.C. 154(b) by 81 days.

This patent is subject to a terminal disclaimer.

(21) Appl. No.: 14/486,333

(22) Filed: Sep. 15, 2014

(65) Prior Publication Data

US 2015/0000213 A1 Jan. 1, 2015

Related U.S. Application Data

(63) Continuation of application No. 13/340,474, filed on Dec. 29, 2011, now Pat. No. 8,833,000.

(60) Provisional application No. 61/427,890, filed on Dec. 29, 2010.

(51) Int. Cl.
*E04B 1/19* (2006.01)
*E04B 1/34* (2006.01)

(52) U.S. Cl.
CPC . *E04B 1/34* (2013.01); *E04B 1/19* (2013.01); *E04B 2001/1996* (2013.01)

(58) Field of Classification Search
CPC ..... E04B 1/19; E04B 1/34; E04B 2001/1996
See application file for complete search history.

(56) References Cited

U.S. PATENT DOCUMENTS 3,063,521 A 11/1962 Buckminster
3,169,611 A * 2/1965 Snelson ..... E04B 1/19 256/37
3,745,777 A * 7/1973 Blenkarn ..... E02B 17/00 405/211
3,901,551 A * 8/1975 Wiesner ..... A47C 4/286 297/440.11
4,207,715 A * 6/1980 Kitrick ..... E04B 1/19 428/542.2
4,655,022 A * 4/1987 Natori ..... B64G 9/00 52/108

(Continued)

OTHER PUBLICATIONS

Val Stavrev, Tensile Stars, Internet Publication http://www.visign.org/pdf/TensiStars.pdf, 2007, 3 pages, Helium ET, Bulgaria.

(Continued)

*Primary Examiner* — Ryan Kwiecinski
(74) *Attorney, Agent, or Firm* — Thomas P. O'Connell; O'Connell Law Firm

(57) ABSTRACT

A tensegrity structure with one or more tensegrity units formed by a membrane in combination with three or more elongate compression members obliquely disposed in a spiral relationship in compression within the membrane. The ends of the compression members within each tensegrity unit and in adjacent tensegrity units are spaced from one another, and the compression members of adjacent tensegrity units overlap along a longitudinal dimension. The membrane forms anticlastic curves and has variable double curvature between ends of compression members. Multiple tensegrity units can form a column, which can be tapered, curved, or otherwise constructed.

23 Claims, 23 Drawing Sheets

(56) References Cited

U.S. PATENT DOCUMENTS

| | | | | | |
|---|---|---|---|---|---|
| 4,711,062 | A * | 12/1987 | Gwilliam | E04B 1/19 | 52/646 |
| 4,731,962 | A * | 3/1988 | Kittner | A63H 33/103 | 135/121 |
| 5,642,590 | A * | 7/1997 | Skelton | B64G 9/00 | 52/641 |
| 6,868,640 | B2 * | 3/2005 | Barber | A47B 13/02 | 108/150 |
| 6,901,714 | B2 * | 6/2005 | Liapi | E04B 1/19 | 343/915 |
| 6,931,812 | B1 * | 8/2005 | Lipscomb | E04B 1/19 | 52/648.1 |
| 7,278,245 | B2 * | 10/2007 | Rouse | A47B 3/002 | 108/118 |
| 7,578,307 | B2 * | 8/2009 | Ung | E04H 15/425 | 135/120.4 |
| 8,826,602 | B1 * | 9/2014 | Lipscomb | E04B 1/19 | 52/648.1 |
| 2002/0002807 | A1 * | 1/2002 | Newland | E04B 1/19 | 52/645 |
| 2003/0009974 | A1 * | 1/2003 | Liapi | E04B 1/19 | 52/633 |
| 2003/0182874 | A1 * | 10/2003 | Barber | A47B 13/02 | 52/81.1 |
| 2004/0068940 | A1 * | 4/2004 | Amir | E04B 1/34 | 52/80.2 |
| 2004/0134141 | A1 * | 7/2004 | Hebbelinck | E04H 15/18 | 52/223.1 |
| 2004/0261351 | A1 * | 12/2004 | Ung | E04H 15/425 | 52/693 |
| 2011/0005160 | A1 * | 1/2011 | Nihei | B25J 9/1075 | 52/645 |

OTHER PUBLICATIONS

Hugh Thompson, Tensegrity: Membranes, Internet Publication http://spatialgeometrix.blogspot.com/2010/10/tensegrity-membranes.html, Oct. 4, 2010, 3 pages, Hugh Thompson, United Kingdom.

Toby Burgess, Phase 2 Gallery Exhibition / Internet Publication http://www.digitalhinterlands.com/exhibitor/toby-burgess, Sep. 8, 2009, 3 pages, United Kingdom.

Anne Niemetz & Andrew Pelling, The Dark Side of the Cell Los Angeles County Museum of Art Concert & Exhibition / Internet Publication http://www.darksideofcell.info/installation.html, Jun. 2, 2004, 3 pages, Los Angeles, California.

Lasse West, Culm and Cover, Design Competition / Internet Publication http://www.conbam.de/halmundhuelle.html?&L=1%22%20onfocus%3D%22blurLink%28this%29%3B, CONBAM, TRINEX, Aug. 9, 2005, 4 pages, Jteichen, Germany.

Florian Idendburg & Jing Liu, In Tention, Sukkah City, Exhibition / Internet Publication http://so-il.org/artifact/66, http://img.sukkahcity.com/1600s/343_1600.jpg, Sep. 19, 2010, 4 pages, New York, New York.

Mizuki Shigematsu et al., Form finding analysis of tensegrity membrane structures based on variational method, Proceedings of the 6th International Conference on Computation of Shell & Spatial Stuctures / Internet Publication http://ecommons.cornell.edu/handle/1813/11521, May 28, 2008, 4 pages, Ithaca, New York.

Tristan D-Estree Sterk, Orambra Ultra-Lightweight Skyscrapers / Internet Publication http://www.orambra.com/~filamentosa.html, Orambra, Approx. 2004, Chicago, Illinois.

Trinex—WayBack machine Mar. 25, 2008.

* cited by examiner

CONTINUOUS TENSION, DISCONTINUOUS COMPRESSION SYSTEMS AND METHODS

RELATED APPLICATIONS

This application is a continuation of application Ser. No. 13/340,474, filed Dec. 29, 2011, which issued as U.S. Pat. No. 8,833,000 on Sep. 16, 2014 and which claimed priority to Provisional Application No. 61/427,890, filed Dec. 29, 2010, both of which being incorporated herein by reference.

FIELD OF THE INVENTION

This invention relates generally to structural frameworks. More particularly, disclosed herein is a novel and improved structure of elongate compression members placed within a membrane in tension to create a self supporting structure with the compression members separated from one other and retained by the membrane.

BACKGROUND OF THE INVENTION

The present invention forms part of a well established class of structures often referred to as tensegrity structures, possessing characteristics of discontinuous compression and continuous tension, where elongate members are separately placed either in tension or compression to form a self-supporting lattice. These types of structures achieve significant weight-to-strength ratios by eliminating compression members from the structural framework and replacing them with tension members wherever possible. Tensegrity structures take advantage of the high strengths that are possible for certain materials in tension and the fact that materials in pure tension do not require additional mass or added dimension in cross section to resist buckling in compression. As a result, tensegrity structures also achieve significant visual lightness as a substantial portion of the framework comprises rods, cables, or thread with diameters significantly less than the diameters or cross sectional dimensions of the compression members. A further lightness of appearance is achieved in these systems where the compression members are truly discontinuous, with no overlaps or contact, appearing to float within a continuous network of attenuated tension members.

The several continuous tension, discontinuous compression systems known to us comprise basic modules which combine to create larger structural forms, such as columns, beams, arches, planes and domes, to name a few. The basic modules of the larger aggregate structures comprise structures of their own in the form of polygons—when the compression members and the tension members are more or less co-planar—and polyhedra or prisms—when the members define the edges of a volume in space—with rigid compression struts supported in space and separated entirely from each other by a network of tension members anchored to and pulling from the ends of adjacent compression members. In these cases of existing art, the tension and compression members of the module structures are linear, an expression of the forces within the system resolved as pure axial loads. When the structural modules comprise polyhedra and prisms, the tension and, additionally or alternatively, the compression members of the structure define the linear edges and the faces of the tensegrity module.

Planar or spherical aggregates of these modules, or planar aggregates that join to create curved forms, can be construed as a lattice membrane, the weave of the membrane comprising both the continuous tension network and the discontinuous compression members, with the dimensions of the module determining the minimum thickness of the membrane. On the scale of the individual modules, however, the linear tension and compression members of the structure define the edges of a space, and the faces of the structure so defined are open and do not constitute an enclosing membrane. At scales where an aggregate of tensegrity modules is not construed as a continuous woven fabric, the tensegrity module functions as a three-dimensional frame, and additional material must be supplied to the structural framework to enclose the defined space, possibly as exterior panels or curved or triangulated infill panels attached to the tension and compression members of the structure. An alternative to panels or modular infill at the building scale is to provide enclosed volumes as independent objects nested and supported inside of the structural frame. These techniques of providing enclosure, however, are common practices utilizing many types of structural frames for support, and are not unique to frameworks comprising discontinuous elongated compression members and networks of elongated, articulated tension members.

In another example of existing art, tension membrane panels replace a number of the linear tension members of the tensegrity structure. The tension membrane panels lie in the same plane or face typically defined by the tension and compression members, or, in cases where the tension member defines the edge of two adjacent triangular faces, the tension membrane panel forms a hyperbolic paraboloid panel. The corners or apexes of these panels anchor to the ends of the compression members, pulling the ends of the members together in a fashion similar to the substituted linear tension members. With the requirement that all areas of the panel surface experience tension, the edges of these panels assume a catenary curvature between the anchor points. The panels attenuate toward the corners and assume a more or less cruxiform shape of catenary curves.

While a network of such panels can be considered a continuous tension network in the same fashion as a network of linear tension elements, substantial gaps exist between adjacent panels and between panels and compression members in examples of art utilizing this system. Consequently, the proliferation of edges renders a discontinuous surface. Further disadvantage results from the phenomena of flutter where vibrations are created by the steady flow of air or liquid over these edges.

Prior art structures utilizing a continuous tension membrane for enclosure include a class of freestanding tent. In such structures, discontinuous elongated flexible members are combined end to end to create substantially longer members. Those longer members are then used in bending to combine the properties of compression and tension to provide pre-stressing and arch support to the structure.

The invention disclosed herein, while similar in its use of a membrane to provide structure and enclosure, differs significantly from these prior art tent and related structures. As taught herein, for example, elongate members are configured purely for axial compression and not for bending. Therefore, they have significantly less flexibility and smaller ratios of slenderness. Furthermore, pre-stressing of the system does not occur as a result of energy stored in the elongate compression members through bending of the members.

It will also be known to one skilled in the art that fully enclosed structures exist wherein elongated compression members of uniform or slightly variable length radiate more or less from a common intermediate point or from several intermediate points along and generally towards the ends of a single axial compression member. The compression members of these structures support a continuous closed, anticlastic membrane with peaks corresponding to the ends of the compression members that are held in place by the uniform pull of the membrane. The intersecting compression members in such structures cannot be characterized properly as discontinuous. The resulting structures describe star-like, radiating forms of combined conical double curved surfaces, resembling complex polyhydra. Likewise, as proven out by prior art structures, each module is a closed system unto itself. The usefulness of these structures is further undermined by the density of the compression members at their centers, which effectively fills instead of creating space at the center of the enclosure. The present inventor has recognized that similar volumes of space can be achieved with more efficient use of material and space and better volume-to-weight ratios using discontinuous compression members.

Other notable examples exist in prior art wherein a continuous membrane is stretched or draped over a pre-stressed scaffolding comprising a single structural module. The scaffolding comprises a framework of discontinuous elongate members held in compression by a continuous lattice of attenuated, linear tension members. In prior art disclosures by Anne Niemetz and Andrew Pelling (*The dark side of the cell*, audio-visual installation, 2004, United States) and more recently by Florian Idenburg and Jing Liu (*In Tension*, Installation, 2010, United States) a membrane or mesh wrapper induces catenary curvature in linear tensile members in scaffolding. The membrane or mesh assumes anticlastic double curvature while contributing additional pre-stress and embodied energy to the structure. This assertedly provides increased stability.

Lasse West disclosed a freestanding display structure utilizing a single tripod of discontinuous, elongate compression members held in compression by a continuous band of tensile membrane (*Trinex*, Construction, 2004, Germany). The West disclosure represents a recent development in the substitution of a tensile membrane for the continuous lattice of elongated tension members in pre-stressed continuous tension, discontinuous compression structural systems. As disclosed by West, a prestressed, anticlastic membrane directs tensile forces to the ends of the discontinuous compression members as axial compressive loads. Evidencing the still further attempts of prior art inventors to devise elegant and effective tensegrity structures, Mizuki Shigematsu, Masato Tanaka and Hirohisa Noguchi have disclosed a similar module of tensegrity membrane structure based on a variational method (*Form finding analysis of tensegrity membrane structures*, Conference Paper, 2008, United States and Japan). Under their teachings, a single layer of a diamond-pattern system of continuous tension, discontinuous compression construction is employed. Following the prismatic model, the tensile membrane in this module engages the discontinuous compression members along their entire length. Each compression member is incorporated into the exterior surface as the edge of a linear crease. This condition induces bending loads in the compression member and requires design for bending and for axial loads yielding a resulting loss in the weight and material efficiencies of the system. The compression member must assume the function not only of a tent pole but also that of a ridge beam under uniform loads. Furthermore, the edge of the membrane at the continuous attachment to the linear compression member also panelizes the membrane, in such a way that it no longer assumes the form of a minimal surface spanning the outermost edges of the structure. This increases the surface-to-volume ratio of the structure and reduces the efficiency of material used relative to the volume of enclosed space. These shortcomings are compounded when the diamond-pattern system is utilized to create multi-layered tubular figures employing tension membranes as disclosed by Mizuki Shigematsu et al. The resulting panelization of the membrane creates discontinuities, invaginating the membrane surface while interfering with the even distribution of loads. This effectively reduces the area of the membrane engaged with loads applied to the structure.

With an awareness of the disclosures of the prior art and the shortcomings thereof, the present inventor has appreciated that there remains a need for improved tensegrity structures that exhibit desirable structural integrity while providing for efficiency in the use of material and enclosure of space and improved volume-to-weight and volume-to-surface ratios.

SUMMARY OF THE INVENTION

With a knowledge of the state of the art as summarized above, the present inventor set forth with the basic object of devising of tensegrity structures and methods for exploiting the same that exhibit desirable structural integrity while providing for efficiency in the use of material and enclosure of space while providing opportunities for improved volume-to-weight and volume-to-surface ratios.

A further object of embodiments of the invention is to provide tensegrity structures that can pursue widely variable shapes and sizes.

In certain embodiments, an object of the invention is to provide an essentially self-enclosing, generally tubular structure of variable length and diameter formed by multiple, potentially consecutive, units of discontinuous compression members in combination with a continuous tension membrane.

An underlying object of the invention is to provide tensegrity structures and methods for using the same that are adaptable to numerous applications, including but not limited to, tubular column and beam constructions, the design and construction of free standing buildings, the design and fabrication of free-standing fixtures, such as floor lamps and other structures, that require structure and shading, the design and construction of kites, and the design and construction of sculptures. Of course, other structures are contemplated and well within the scope of the invention except as it might be expressly limited.

These and in all likelihood further objects and advantages of the present invention will become obvious not only to one who reviews the present specification and drawings but also to those who have an opportunity to examine, use, and witness the structure and performance of the compression systems and methods disclosed herein. Although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth the aforementioned objects, a tensegrity structure according to the invention has a pre-stressed membrane that can comprise a substantially continuous, resilient material with an inner surface and an outer surface. At least a first tensegrity unit is formed by the membrane in combination with at least three elongate compression members. With that, the membrane can be considered to act as a sheath in the broadest use of the term in that it encases the compression members when the tensegrity structure is assembled. The membrane can be substantially tubular, and the resulting tensegrity can approximate a tubular configuration. It will be understood, however, that the concept of a tubular configuration or the like as used herein shall not require that the structure be round or smooth in cross section.

The elongate compression members are obliquely disposed in compression within the membrane to establish an open inner volume therein. Each compression member has a first end that applies force to the membrane at a first location and a second end that applies force to the membrane at a second location spaced from the first location. The ends of the compression members are not in contact with one another whereby the compression members can be considered to be discontinuous. Compression members that are not in contact with one another and not in contact with any other supporting structure apart from the membrane are supported entirely by the membrane, which in turn they support. The membrane and the several compression members thus cooperate to provide a mutually supportive structure.

The tensegrity structure can be considered to have a longitudinal axis, and the compression members of each tensegrity unit can be crossed between their ends in a spiral in relation to the longitudinal axis. Within the present specification and claims, reference to a longitudinal axis shall not be considered to require that the tensegrity structure or the longitudinal axis be straight. Indeed, resulting tensegrity structures can be curved, straight, or otherwise formed. Furthermore, as used herein, the term discontinuous shall not necessarily require that the bodies or mid-portions of the compression members be out of contact, and the claims should not be interpreted to require the same except as they might be expressly limited. As shown in the drawings, however, embodiments of the invention are contemplated where the entire mid-portions of the compression members within each tensegrity unit and as between adjacent compression units are also not in contact.

Embodiments of the invention can have multiple tensegrity units so formed. The multiple tensegrity units can have the same or different numbers of compression members. The compression members of adjacent tensegrity units can also not be in contact so that they too are discontinuous. Where the tensegrity structure is considered to have a longitudinal dimension and a lateral dimension, compression members of adjacent tensegrity units can overlap along the longitudinal dimension. With the tensegrity structure so formed, the membrane can form anticlastic curves and can have variable double curvature between ends of compression members.

Whether the tensegrity units have three, four, or more compression members, the compression members of adjacent tensegrity units can spiral in common or opposite orientations. For example, all compression members can spiral clockwise or all compression members can spiral counter-clockwise around the longitudinal axis. In other embodiments, the compression members of one or more tensegrity units can spiral in a clockwise direction while one or more others can spiral in a counter-clockwise direction.

Where the compression members are crossed in a spiral between the ends of the compression members and in relation to the longitudinal axis, the compression members can establish a gap β about the longitudinal axis. That gap β can be exploited in certain manifestations of the invention, such as for the retention of articles and other structures. Where the tensegrity structure comprises a building structure, for example, a column, such as an elevator column, can communicate within the gap β.

Means can be provided for selectively adjusting a length of the compression members. With that, the membrane can be selectively pretensioned by a selective lengthening of the compression members.

Where plural tensegrity units are each formed by the membrane in combination with at least three elongate compression members, the elongate compression members will again be obliquely disposed in compression within the membrane to establish an open inner volume therein. The ends of the compression members of each tensegrity unit will preferably not be in contact with one another so that they are discontinuous and supported by the membrane. Likewise, the compression members of adjacent tensegrity units are preferably not in contact whereby they too are discontinuous. Within each tensegrity unit, the compression members of each tensegrity unit will again be crossed in a spiral between the ends of the compression members and in relation to the longitudinal axis of the tensegrity structure.

In such embodiments, the tensegrity structure can take the form of a tapered column achieved, for example, by a sequential reduction in length of the elongate compression members of adjacent tensegrity units. In further embodiments, the tensegrity structure can comprise a curved structure. This can be realized by, for example, a curvature induced by a variation in length of elongate compression members within each compression unit or by a variation in overlap between adjacent tensegrity units. In each embodiment, reinforcements can be disposed at the ends of the compression members to prevent a piercing of the membrane.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

Figure 1:
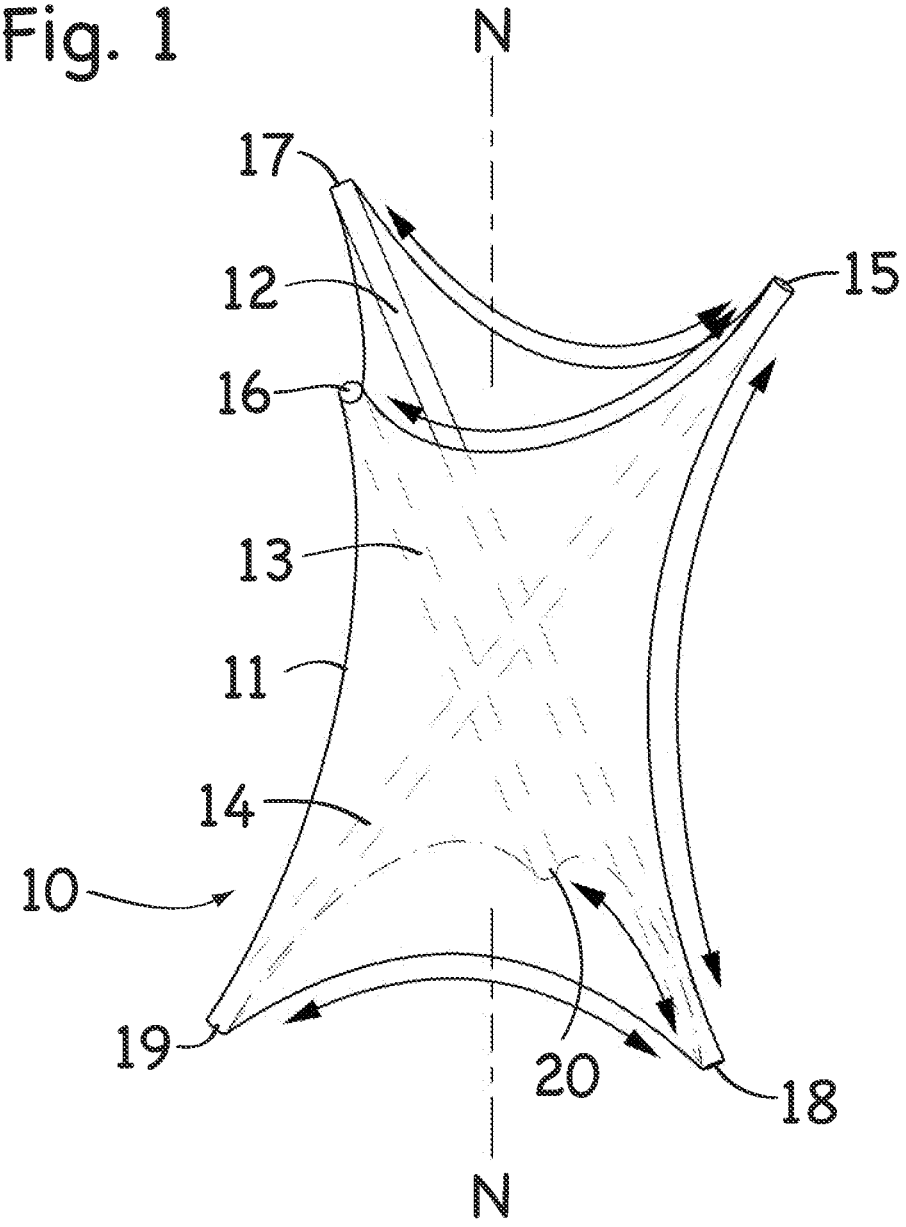
FIG. 1 is a perspective view of a basic module according to the invention utilizing a tripod of detached elongate compression members as a basic unit sheathed in a pre-tensioned membrane.

The tensegrity structures and methods disclosed herein can pursue numerous embodiments within the scope of the invention. However, to ensure that one skilled in the art will be able to understand and, in appropriate cases, practice the invention, certain preferred embodiments of the broader invention revealed herein are described below and shown in the accompanying drawing figures.

The present invention was made in view of the present inventor's discovery that a continuous membrane can replace the network of linear tension members as a structural component for a particular class of continuous tension, discontinuous compression structures. Under embodiments of the present invention, for example, a continuous pre-stressed membrane can be combined with repetitive, overlapping, and interweaving arrangements of discontinuous compression members to create tubular structures of variable length. The structures and methods disclosed herein substitute a continuous surface for the open faces or edges of the continuous tension, discontinuous compression lattice networks of the prior art to create enclosed and continuous interior spaces. Structures according to the invention realize efficiencies of material use and improved volume-to-weight ratios by utilizing the tension membrane as an integral component of the structural system. Elongate, multi-tiered structures according to the invention provide improvements in flexibility and utility over prior art systems previously comprising a single module. The pretensioned membrane of the disclosed structure assumes an anticlastic form of continual curvature and efficient, minimal surface area. The tension and the curvature of the membrane contribute stiffness to the structure while minimizing both the ratio of surface to volume and the energy that must be embodied in the system.

A basic module of embodiments of the invention creates a volume through the retention of three compression members crossed in a spiral intermediate to their ends and held to be self supporting by a continuous sheath of tension membrane. This tripod arrangement of struts can be situated in a network of linear tension members to constitute the basic compression unit of self-supporting linear tensegrity structures. Variations on this basic unit are found in the addition of compression members in a spiral arrangement.

A continuous sheath of tension membrane can effectively replace the lattice of linear tension members in the module, contacting only the ends of the discontinuous compression members and connecting these ends within a pre-stressed membrane. It is a further characteristic of the module that the continuous membrane sheathing assumes a unique form determined by its connections to the ends of the compression members. The form is anticlastic and of continually changing double curvature specific to the disposition of the compression members of the module thereby assuming a shape indicative of the approximately even distribution of stress throughout the membrane. Advantageously, the continuous membrane avoids edges along its length that are relatively unsupported in relation to external forces perpendicular to its surface.

Pursuant to the present invention as described further below, one can create a self-supporting structure of variable length founded on the described module through a combination of extending the continuous, pretensioned membrane sheathing at intervals that can correspond to the longitudinal dimension of the unit arrangement of compression members while adding compression units in support of the extended membrane tube. The added compression units can potentially correspond in number and length of compression members to the previous units, or the compression members can vary in number, size, and otherwise. Particularly where the compression members are of consistent number and size, the resulting structure can be considered analogous to a helical ladder with a pre-tensioned membrane tube substituted for the rails and an arrangement of oblique rungs suspended inside of the tube.

While potentially constructed in a linear, modular fashion, structures according to the invention typically will not comprise an assembly of discreet modules. As an approximation of a minimal surface, the continuous tension membrane that encloses and supports iterative, mutually supporting unit arrangements of compression members assumes a repetitive form related to the basic module while effecting, in a distinctive way, the transmission of forces between the successive units. The resulting structure is to be distinguished from the basic module as a result of, among other things, the overlapping adjacency of two unit arrangements of compression members bound together by the continuous tension membrane. The disclosed structure further distinguishes from those taught by the prior art in that the continuous tension membrane directs forces only to the ends of the compression members. Consequently, only axial loads are imparted on the discontinuous structural elements. The form and disposition of the integrated components resulting from this adjacency are among the unique features of the invention.

Despite the foregoing and further important structural and functional differences as compared to the prior art, tensegrity structures according to the invention may be considered to have certain characteristics in common with prior art methods of creating beams, columns, and arches from modules with a lattice of discontinuous compression members joined by a continuous network of linear tension members. A primary shared characteristic is that the structures as taught herein are pre-stressed, relying on energy stored in the system for stability. Accordingly, the tensile membrane of the disclosed structure shares elasticity properties with the tension networks of prior art, and the currently disclosed structures have a degree of flexibility proportionate to the degree of tension that can be stored in the structure and the elasticity of the pre-tensioned membrane. Embodiments of the structure disclosed herein can be collapsed to a fraction of their extended lengths, subject to the degree of elasticity in the membrane and other factors, while reassuming their full lengths when released. When resiliently compressed in this fashion, the energy input into and released by the structure is nonlinear as with a spring. Also similar to structures of the prior art, individual units composed of the spirally arranged compression members according to the invention possess left and right handed rotational characteristics in responding to external forces. These may be utilized to neutralize the distortion caused by such forces on a structure composed of two or more modules. This can be accomplished, for example, by mirroring the spiral arrangement of compression at each successive module.

Figure 2:
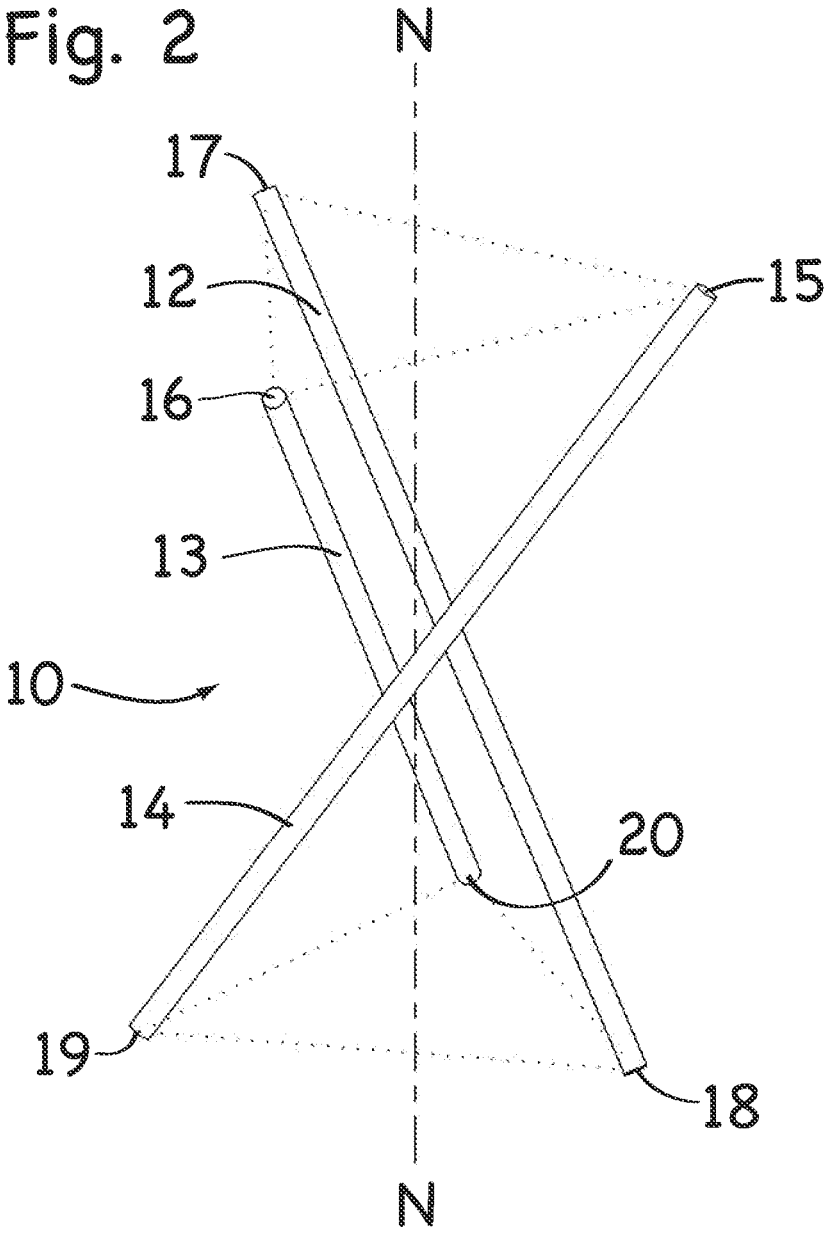
FIG. 2 is a perspective view of a basic tripod arrangements of compression struts as a structural compression unit of the invention.

Looking first to FIGS. 1 through 5, a basic module according to the invention is indicated generally at 10. In FIG. 1, a pre-tensioned membrane 11 encloses three struts or compression members 12, 13, and 14 as a continuous band or sheath engaging the six ends of the compression members 12, 13, and 14 thereby retaining them in compression. The three compression members 12, 13, and 14 cross intermediate to the ends thereof in a spiral arrangement around a longitudinal axis N. The compression members 12, 13, and 14 can be considered to assume a form that resembles in some respects a 3-legged collapsible chair. This can be best perceived perhaps in FIG. 2 where the membrane 11 is removed to permit the arrangement of the compression members 12, 13, and 14 to be perceived more easily. In FIG. 2, a dotted line spanning between the terminations of the compression members 12, 13, and 14 at either end of the membrane sheath 11 indicate the transverse planes resultantly formed at each end of the basic module 10.

Looking again to FIG. 1, the curvature of the membrane 11 is approximate to that of a minimal surface wherein the overall form results from an equilibrium in the membrane 11. However, it differs in that the distribution of stresses in the membrane 11 is in proportion to the distance from the connections to the compression members 12, 13, and 14 instead of being equal throughout. The curvature of the continuous membrane 11 ensures that the force exerted on each compression member 12, 13, and 14 is coaxial without bending moments and that the force is countered by an equal but opposite axial compressive force.

In the basic module 10, the tendency of the membrane 11 to pull the ends 15 and 18 of legs 12 and 14 toward each other in the longitudinal direction is resisted by an equal force pulling the two ends 15 and 18 in the transverse direction. Thus, a transverse tensile force pulls end 15 toward ends 16 and 17 and another pulls end 18 toward ends 19 and 20. The distribution and equilibrium of these longitudinal and transverse tensile forces in the membrane 11 result in the anticlastic surfaces and catenary edges notable to the invention.

As with prior art discontinuous compression, continuous tension structural systems, the compression members 12, 13, and 14 may be considered to have a left or right handedness depending on the orientations of the compression members 12, 13, and 14. Consequently, the modules 10 defined by the compression members 12, 13, and 14 have a tendency to rotate in a clockwise or counter-clockwise direction when loaded laterally.

Figure 3:
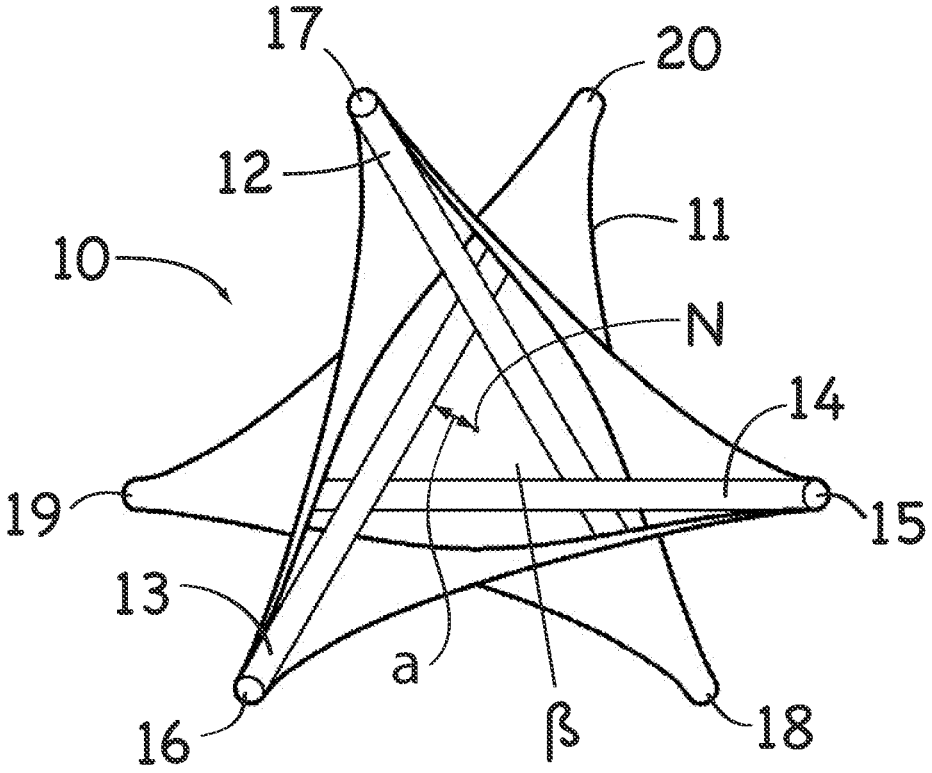
FIG. 3 is a top plan view of the basic module of FIG. 1 along its longitudinal axis with a spiraling arrangement of compression struts and a corresponding form of the pre-tensioned membrane.

FIG. 3 illustrates a basic module 10 viewed longitudinally showing the compression members 12, 13 and 14 arranged in a characteristic spiral relationship around the common axis N and situated a variable distance "a" from that axis so that they are separated from each other, creating a gap β at the center of the module 10. The gap β provides multiple benefits. For example, in a building constructed according to the invention, this gap β could provide an atrium or space in the structure for elevator shafts or other vertical circulation. It will be recognized, however, that the distance "a" may be reduced to zero so that the compression members 12, 13, and 14 contact each other or at least intersect the common axis N thereby eliminating the gap β. The individual compression members 12, 13, and 14 in a compression module 10 may also intersect each other approximately at their midpoints thereby eliminating the left or right handedness of the module 10 as well as the gap β. As shown in FIG. 3, the three overlapping compression members 12, 13, and 14 in the depicted embodiment form a three-way triangle weave unit representing a right-hand spiral arrangement with a tendency rotate in a counter-clockwise direction when subject to longitudinal loads.

Figure 4:
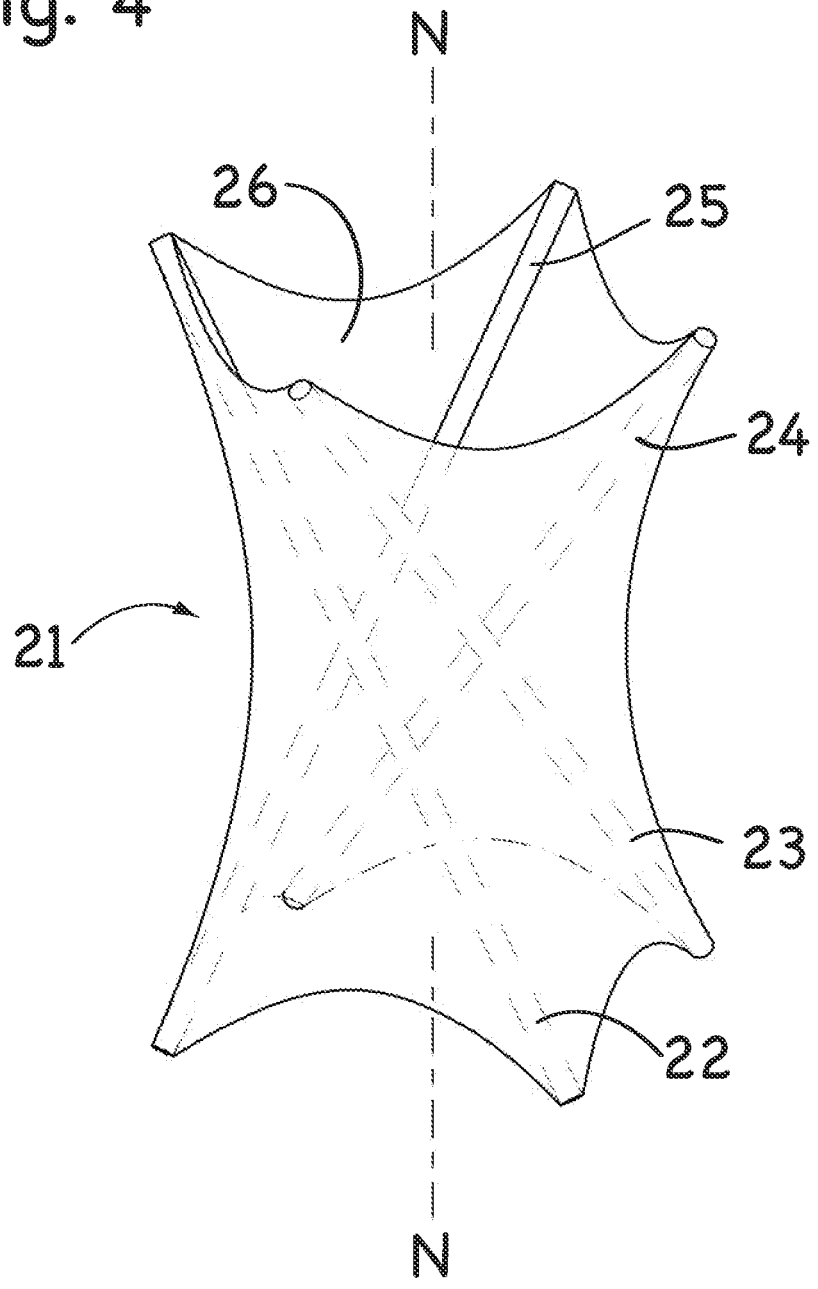
FIG. 4 is a perspective view of an alternative module according to the invention utilizing four elongate compression members.
Figure 5:
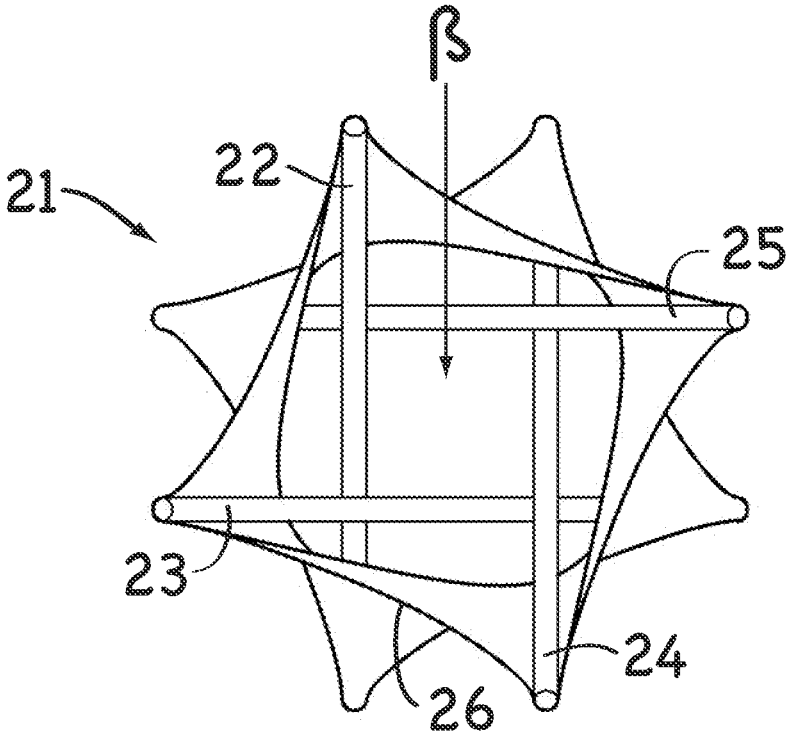
FIG. 5 is a top plan view of the module of FIG. 4 along its longitudinal axis.

The basic module 10 can be altered by adding additional compression members crossing in a spiral arrangement as described. By way of example, FIG. 4 illustrates a four-member module 21 with four compression members 22, 23, 24 and 25 and a single continuous membrane 26 constructed according to the invention. As seen in FIG. 5, which is a view of the module 21 along its longitudinal axis, the four overlapping compression members 22, 23, 24 and 25 depict a two-way plain weave unit in a left-hand spiral arrangement with a tendency to rotate in a clockwise direction when loaded longitudinally.

Figure 6:
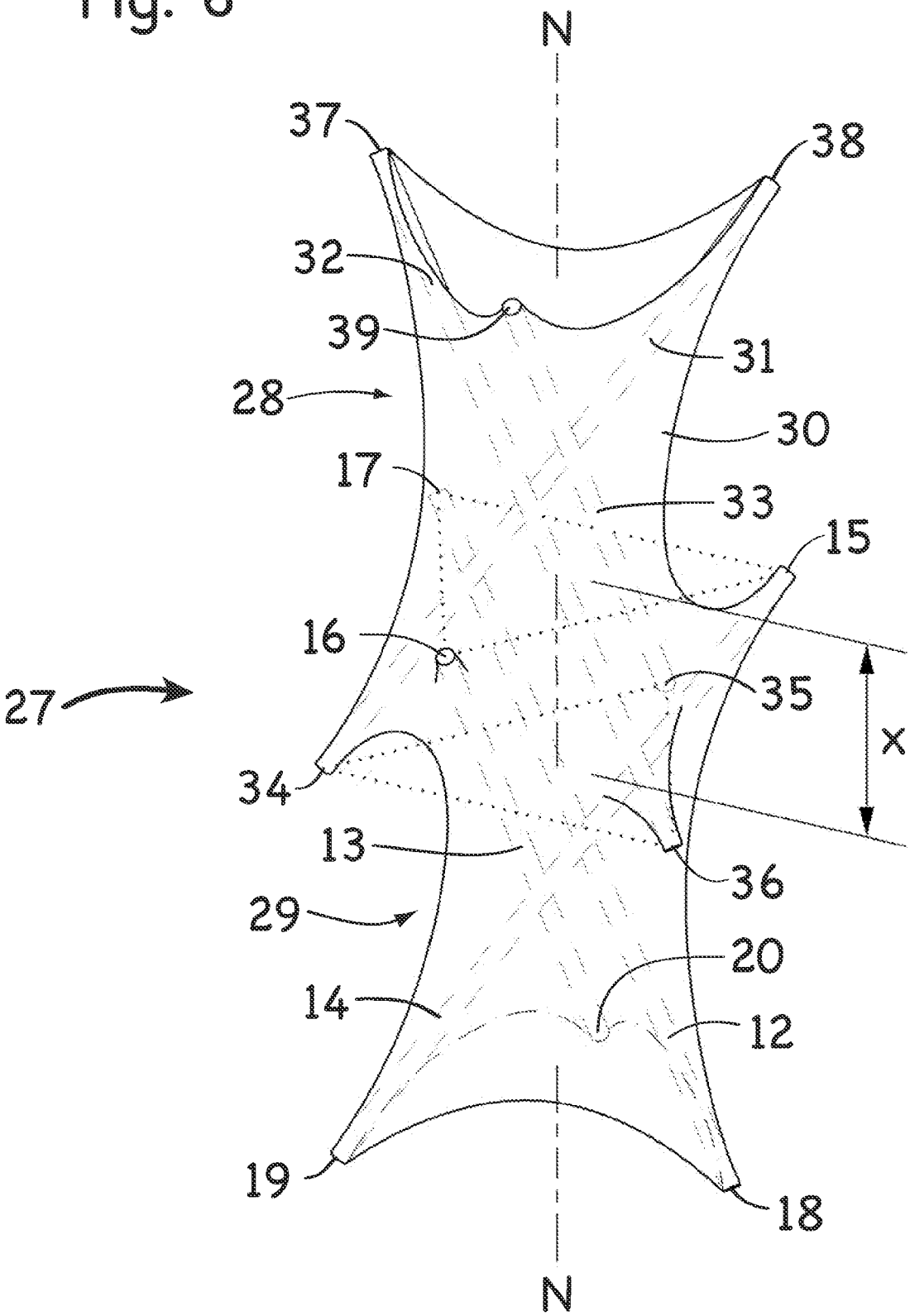
FIG. 6 is a perspective view of a two-tiered structure of mirrored, three strut compression units enclosed by a pre-tensioned membrane.

FIG. 6 illustrates a structure 27 formed by the arrangement of two tiers of 3-legged compression units 28 and 29 along the transverse axis N. The compression units 28 and 29 overlap by distance "x" with the units 28 and 29 held in compression by a continuous pre-tensioned membrane 30. Unit 28 depicts a left-hand arrangement of compression struts or members while unit 29 depicts a right-hand spiral arrangement of compression struts or members. The tendency of the left hand unit 28 to collapse in a clockwise direction is countered by the tendency of the right hand unit 29 to collapse counter-clockwise. In such unit arrangements of three compression struts or members, the ends of the struts define a planar figure, illustrated in FIG. 6 by dotted lines. The distance x in this case is the distance between planar figures formed by the overlapping ends of units 28 and 29 where they intersect the longitudinal axis N. This distance can also be understood to be the mean distance between 34, and 36, the lower ends of the compression struts 31, 32 and 33 in unit 28, and 15, 16 and 17, the upper ends of compression struts 12, 13 and 14 in unit 29.

Figure 7:
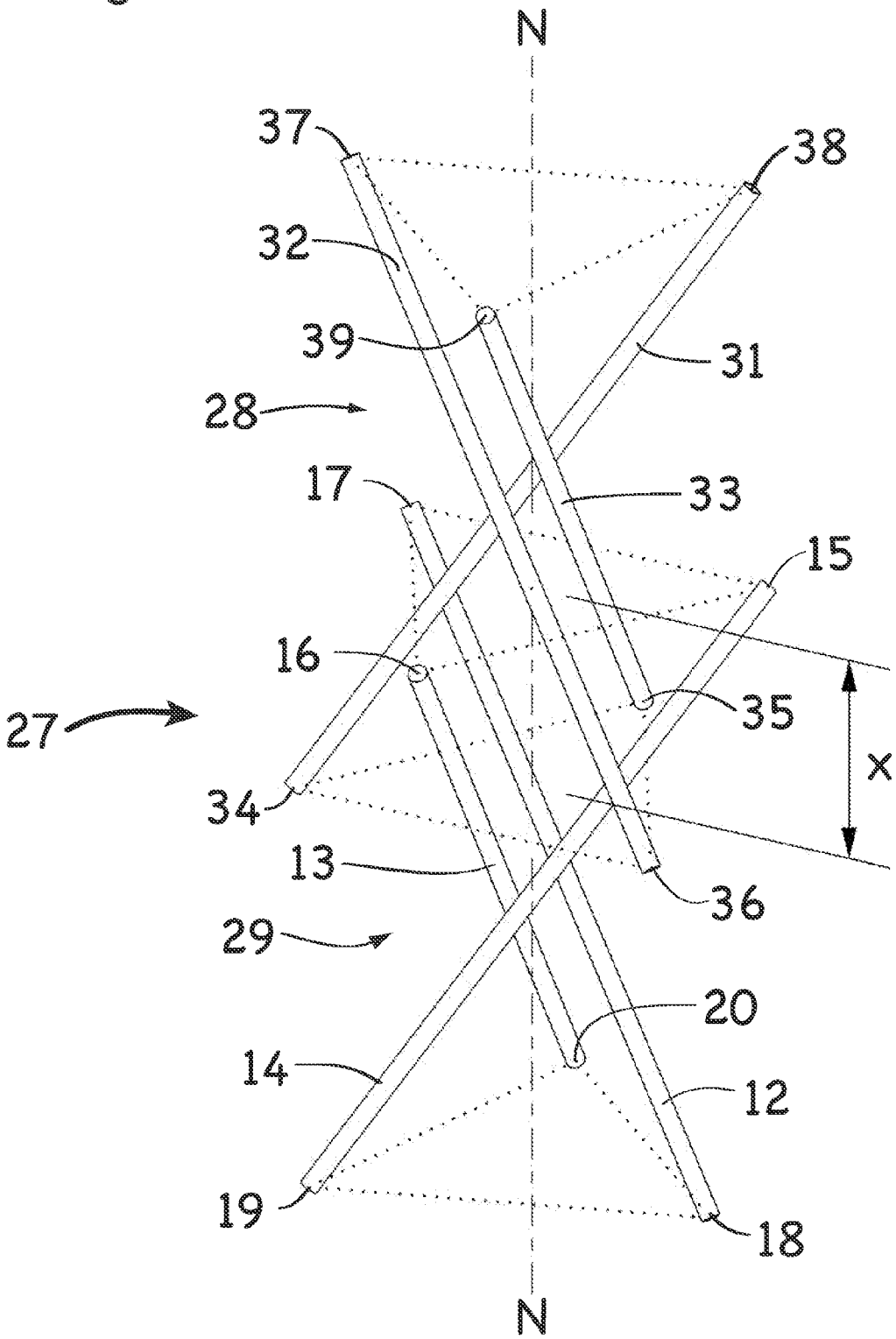
FIG. 7 is a perspective view of the two-tiered structure of mirrored, three strut compression units of FIG. 6 devoid of the pre-tensioned membrane.
Figure 8:
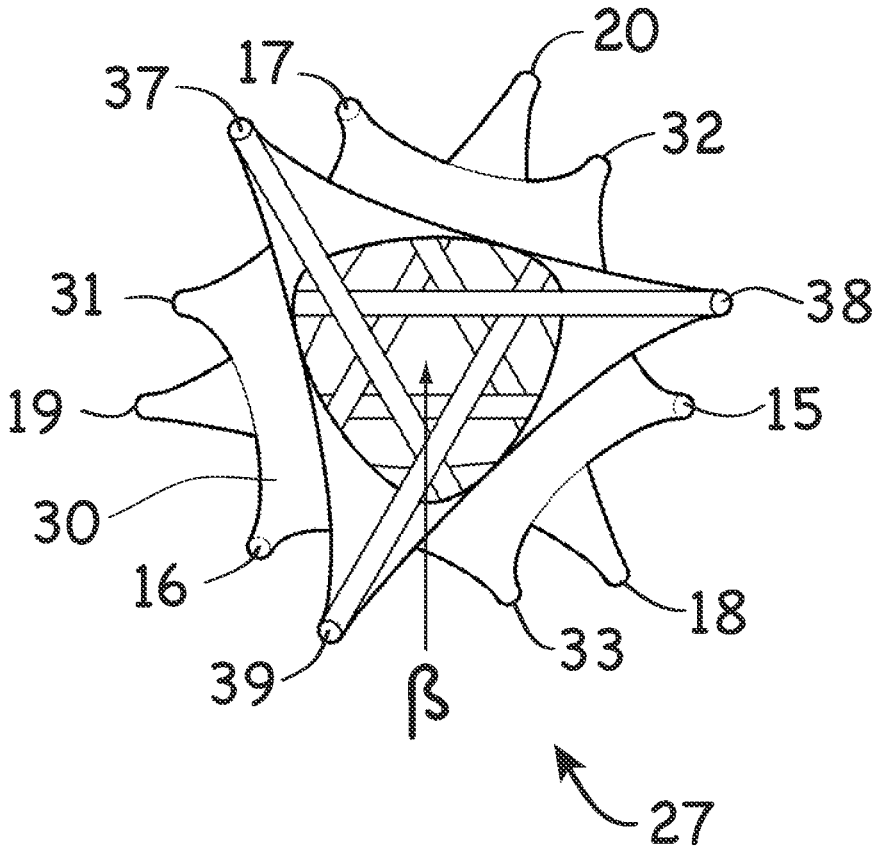
FIG. 8 is a top plan view of the two-tiered structure of FIG. 8 depicting the overlapping, interweaving arrangement of the compression units and the corresponding form of the pre-tensioned membrane.

Turning additionally to FIG. 7, the pretensioned membrane 30 has been removed to illustrate more clearly the mirrored relationship of the compression units 28 and 29 along the longitudinal axis N as well as the interweaving of the overlapped compression struts. As seen in FIG. 8, which is a view of structure 27 along its longitudinal axis, compression strut ends 31, 32, 33, 15, 16 and 17 are arranged in a counter-clockwise spiraling array at the midsection of the structure 27, oppositely to the clockwise arrays of strut ends 37, 38 and 39 and 18, 19 and 20.

Returning to FIG. 6, the tendency of pre-stressed continuous membrane 30 to pull one end of the structure 27, defined by locations 37, 38, and 39, longitudinally towards the other end, defined by locations 18, 19 and 20, is resisted for the most part by compression in the struts and by the equal tendency of the membrane 30 to pull strut ends 15, 16 and 17 closer to strut ends 34, 35 and 36. Described another way, the tendency of the prestressing in membrane 30 to shorten the overall length of structure 27 thereby increasing the overlap of compression units 28 and 29 and increasing distance x is resisted by the equal tendency of the prestressed membrane 30 to decrease the distance x, increasing the overall length by pulling the overlapped compression units in opposite directions along the longitudinal axis.

As a result of the oblique arrangement of the compression struts, all stresses in the struts have horizontal and vertical components thereby linking the longitudinal stresses in the membrane 30 with the transverse, annular stresses. Longitudinal loads, such as loads originating with the weight of construction material, are transmitted to the ground from compression members in unit 28 to the compression members in unit 29 primarily through longitudinal tension in the membrane 30 between strut ends 34, 35 and 36 and strut ends 15, 16 and 17, and annular tension in the membrane that prevents the outward spreading of the strut ends 15, 16, 17, 34, 35, and 36.

Figure 9:
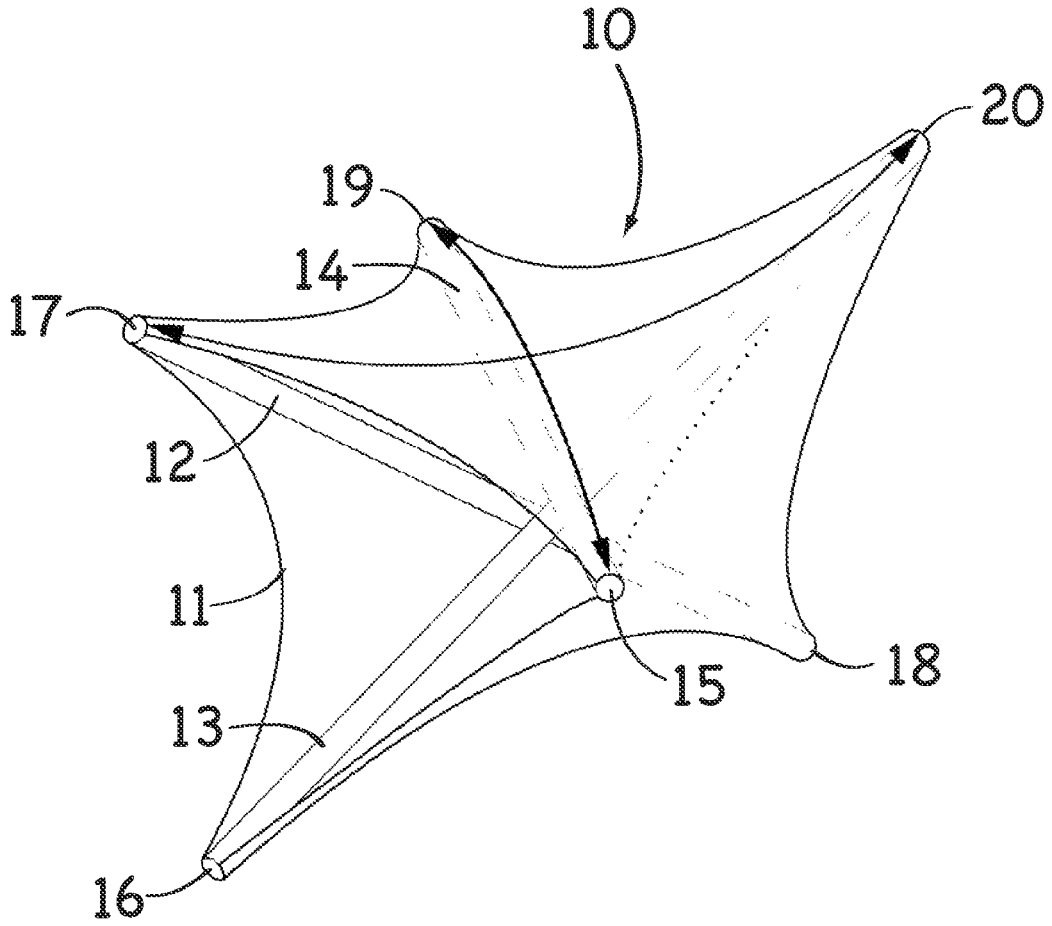
FIG. 9 is a perspective view of the of the basic module of FIG. 1 characterizing the anticlastic surface form of the invention.

It should be noted in relation to each embodiment that the distinct double curvature of the surface of the membranes 11, 26, and 30 is an expression of the simultaneous lateral and transverse tensile forces distributed evenly in the membranes 11, 26, and 30 in relationship to the attached ends of the compression members. FIG. 9 illustrates the basic module 10 of the invention indicating with solid curved lines and arrows the double curvature of a primary face resembling a shallow hyperparabolic paraboloid. While there are no isolated faces or facets of the continuous pretensioned membrane 11, the attached ends of certain pairs of compression members pull the membrane 11 upward in relationship to the downward pull of adjacent end pairs thereby creating rigid saddle shaped, anticlastic surfaces. In FIG. 9 the membrane surface curves outwardly between strut ends 15 and 19 of compression member 14 while simultaneously bending inwardly between strut ends 17 and 20 of compression members 12 and 13. Double curvature occurs at every point on the surface of the membrane 11. Consequently, the total surface can be characterized as a continuous series of constantly blending anticlastic surfaces.

Figure 10A:
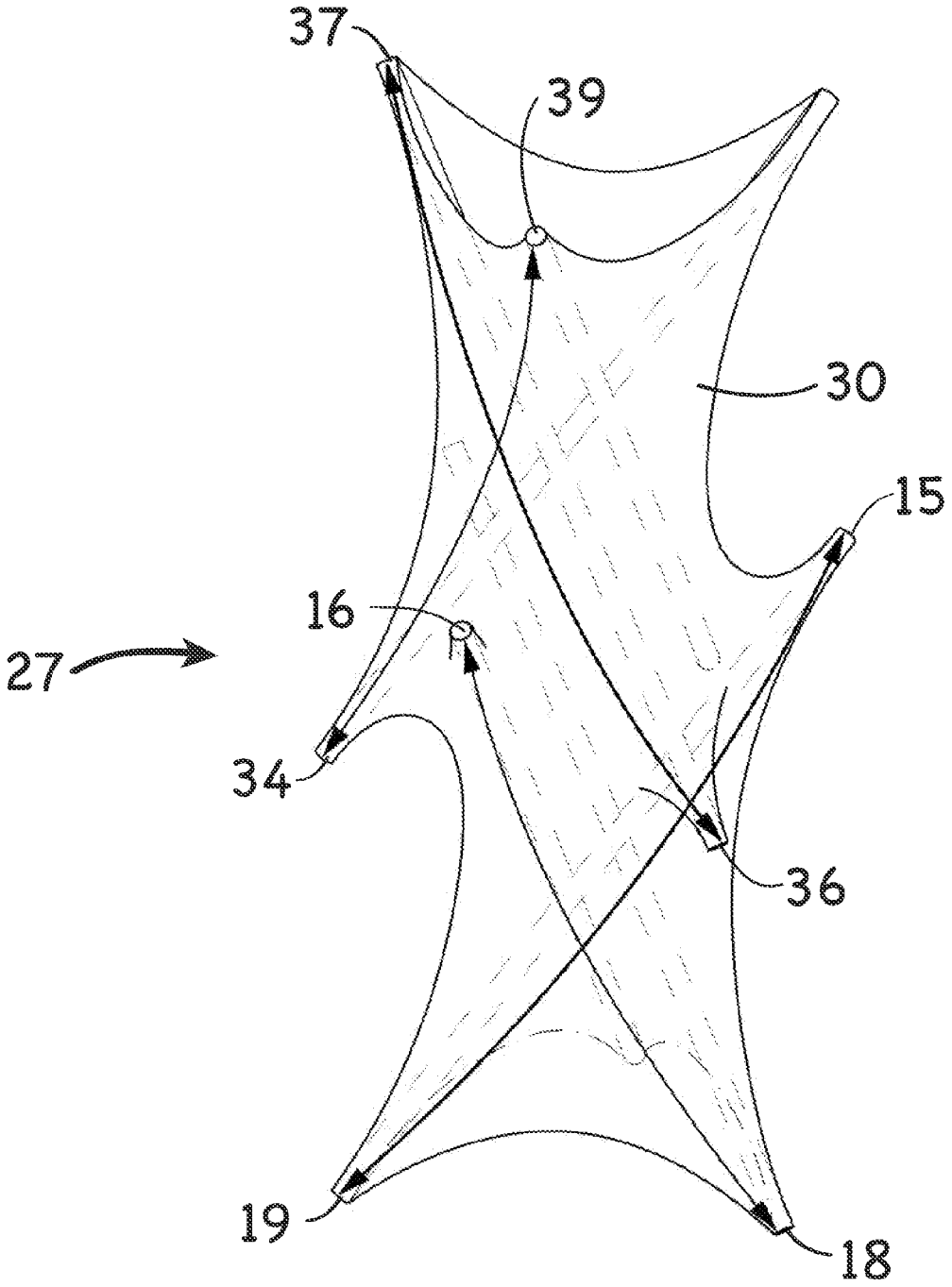
FIGS. 10*a*-10*d* are perspective views of continuous, blended anticlastic surface forms characteristic of the pre-tensioned membrane as a component of the invention.

These anticlastic surface forms of constantly changing curvature can be considered to fall into four basic categories. FIG. 10*a* shows the two-tiered structure 27 according to the invention indicating with curved lines and arrow heads a repeated and mirrored shallow saddle form also seen in the basic module 10 of FIG. 9. In this view, the portion of the membrane 30 between strut ends 36 and 37 and between strut ends 15 and 19 curves outwardly and away from the center of the tube structure 27. The surface curves inwardly, toward the center of the structure 27 between strut ends 34 and 39 and between strut ends 16 and 18.

Figure 10B:
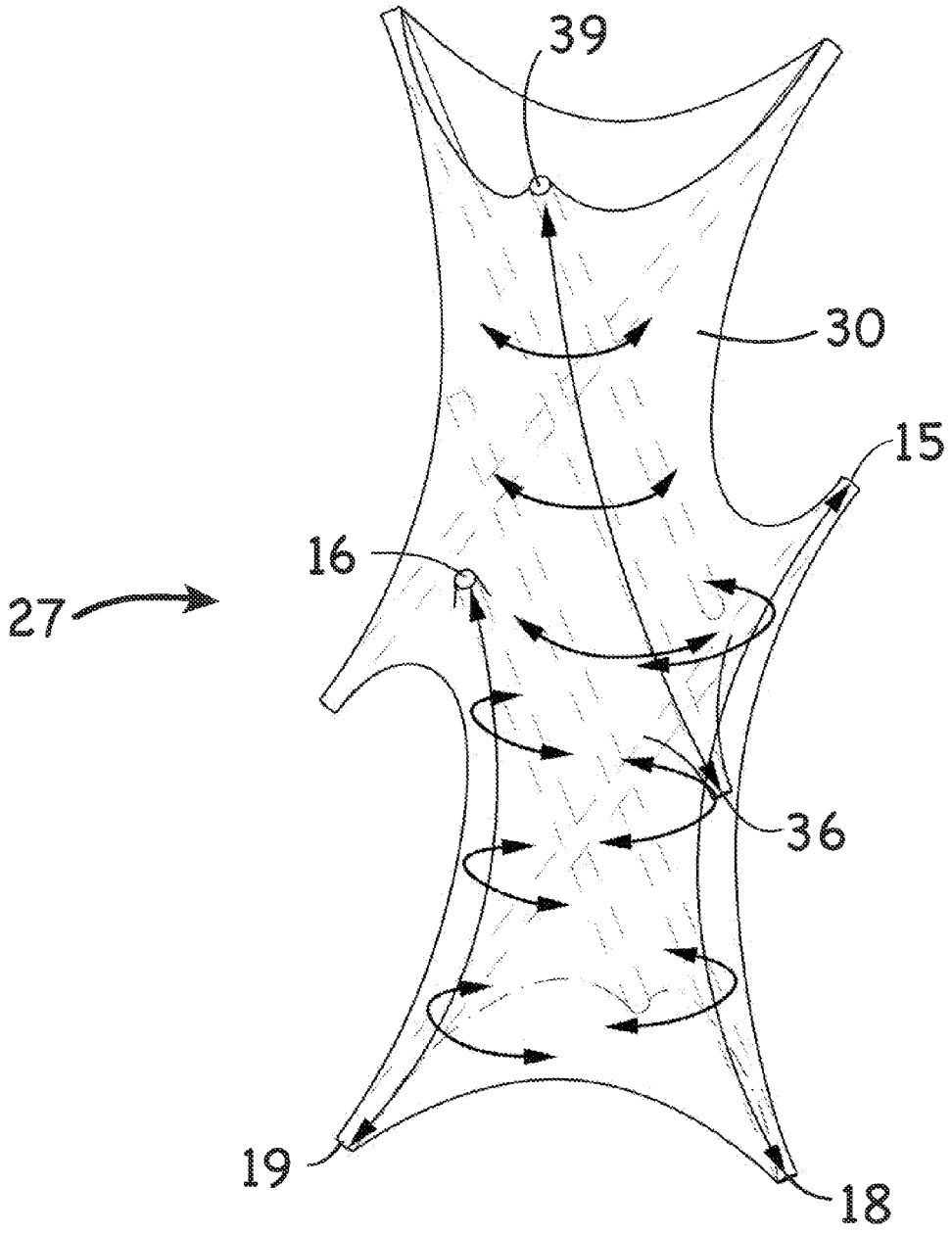

FIG. 10*b* depicts a deeper saddle form repeated and mirrored on the surface of the structure 27. In this view, the portion of the membrane 30 between strut ends 36 and 39, between strut ends 16 and 19, and between strut ends 15 and 18 curves inwardly toward the center of the structure 27. The steeper, outward curvature of this saddle form is defined by the continuous tension in the transverse tubular section of the pre-tensioned membrane 30, and the function of the membrane 30 is as a tension ring transverse the longitudinal axis of the structure 27.

Figure 10C:
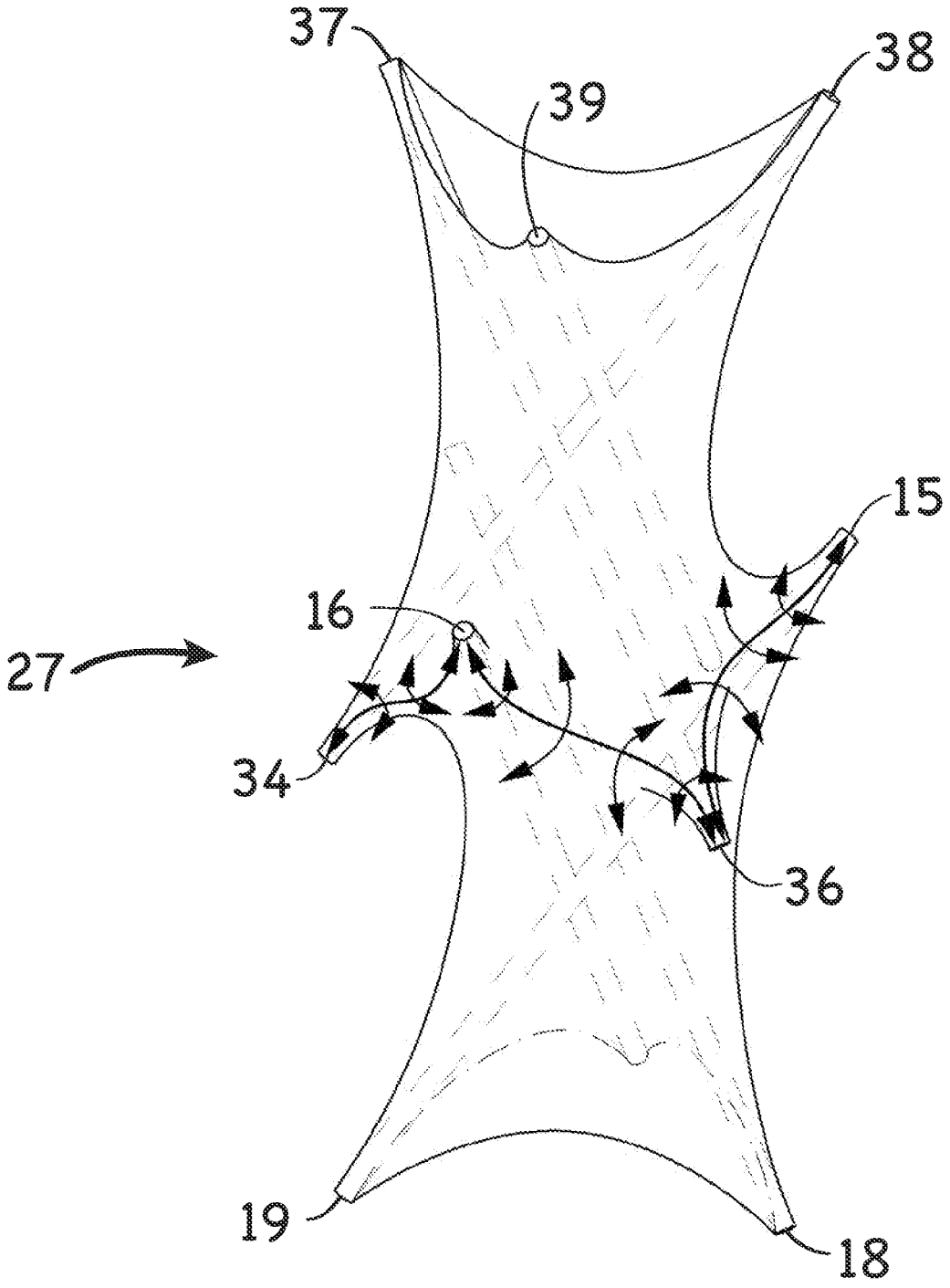

FIG. 10*c* depicts a third form of saddle shaped anticlastic surface along an elliptical arc mirrored and inverted at its mid-span that is repeated between strut ends 16 and 34, 16 and 36, 36 and 15. This anticlastic surface form curves inwardly toward the center of the structure 27 between the indicated strut ends 16 and 34, 16 and 36, 36 and 15. The outward curvature of this saddle form is defined by the continuous tension in the transverse tubular section of the pretensioned membrane 30 and by the tension distributed among strut ends 15, 16, 34 and 36, and 37, 38, 39, 18 and 19.

Figure 10D:
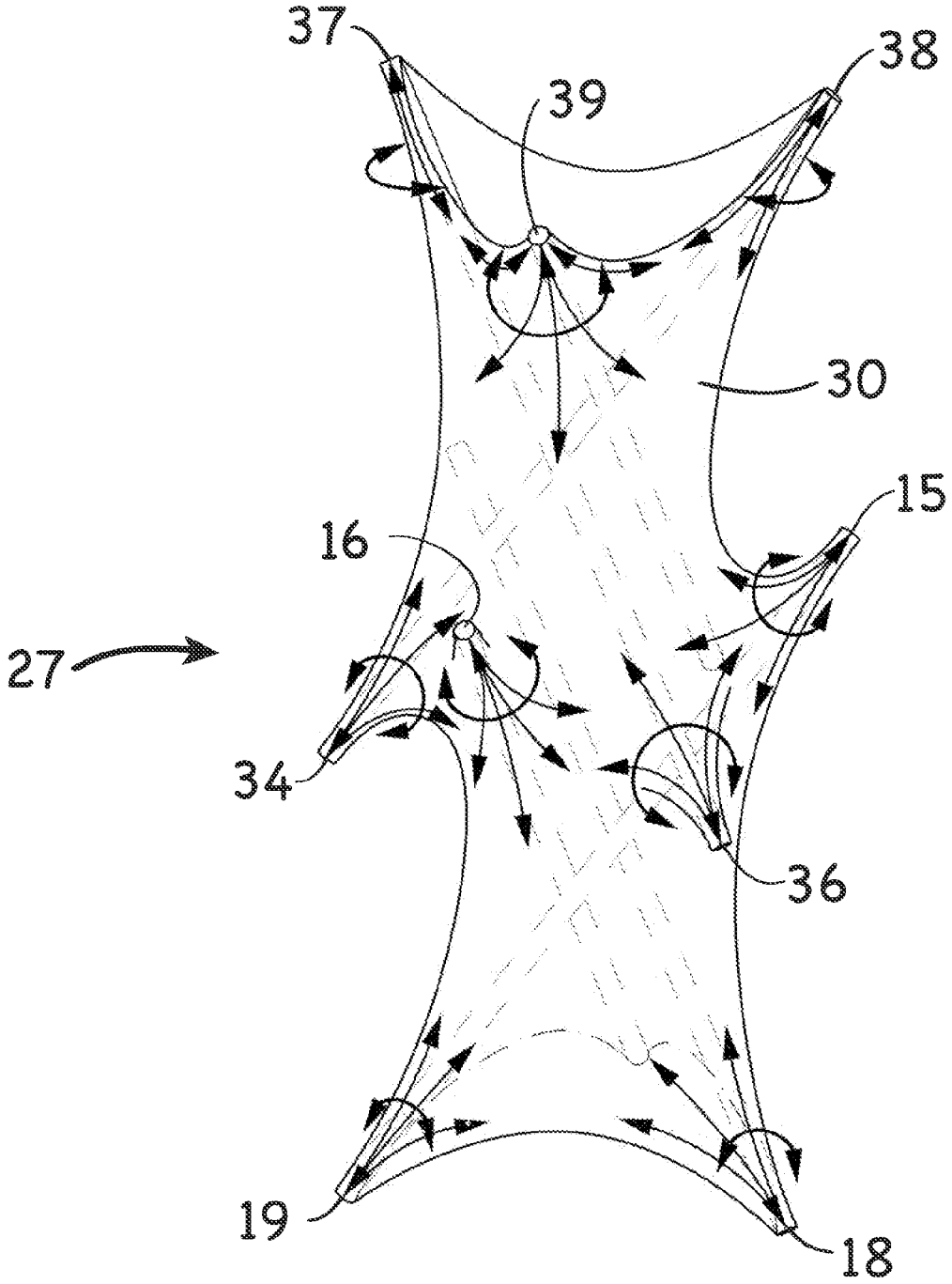

Finally, FIG. 10*d* illustrates the fourth category of conical tent-form anticlastic surface form displayed by structures 27 embodying the invention. This tent-form surface occurs at every compression strut end where it engages the pretensioned membrane 30, here indicated at locations 15-19 and 34-39.

Figure 11:
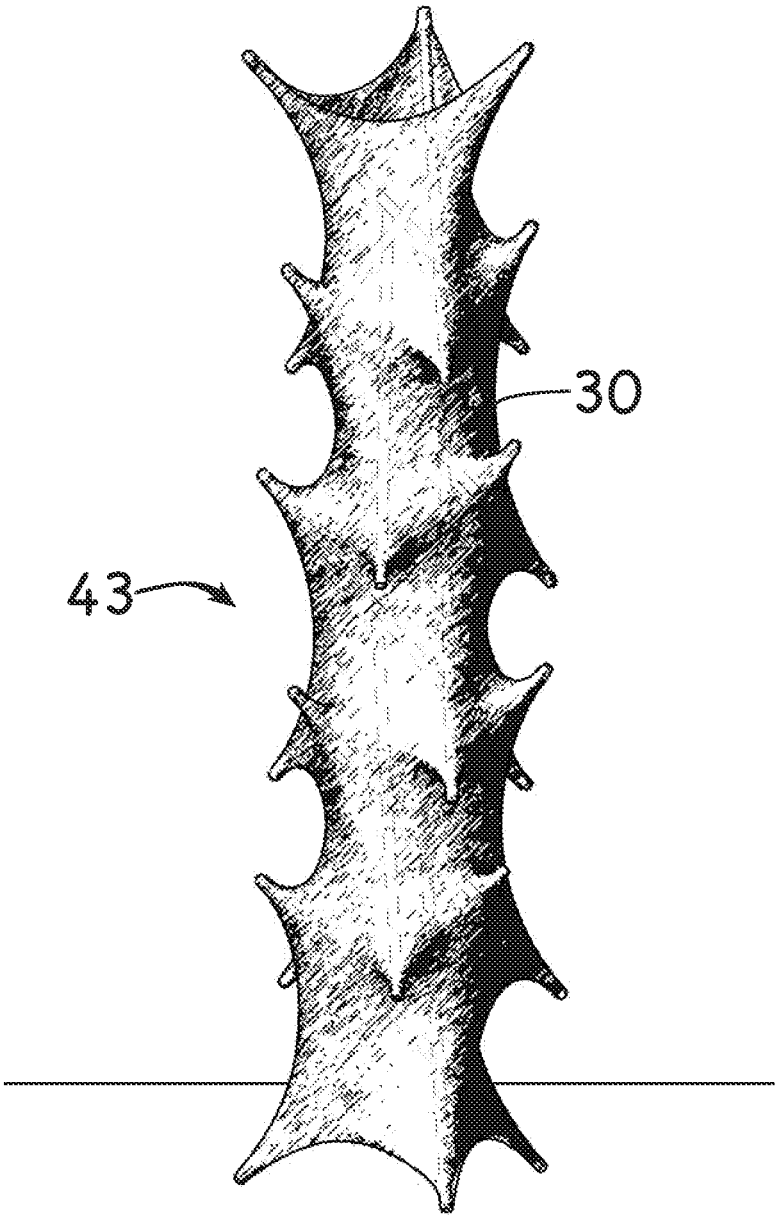
FIG. 11 is a perspective view of a five-tiered structure pursuant to the invention with minor variation in the compression units.

A five-tiered vertical structure constructed according to the invention is indicated at 43 in FIG. 11. The contours of the pre-tensioned membrane 30 comprising blended anticlastic surface forms are fully represented in the shaded rendering of FIG. 11

Figure 12:
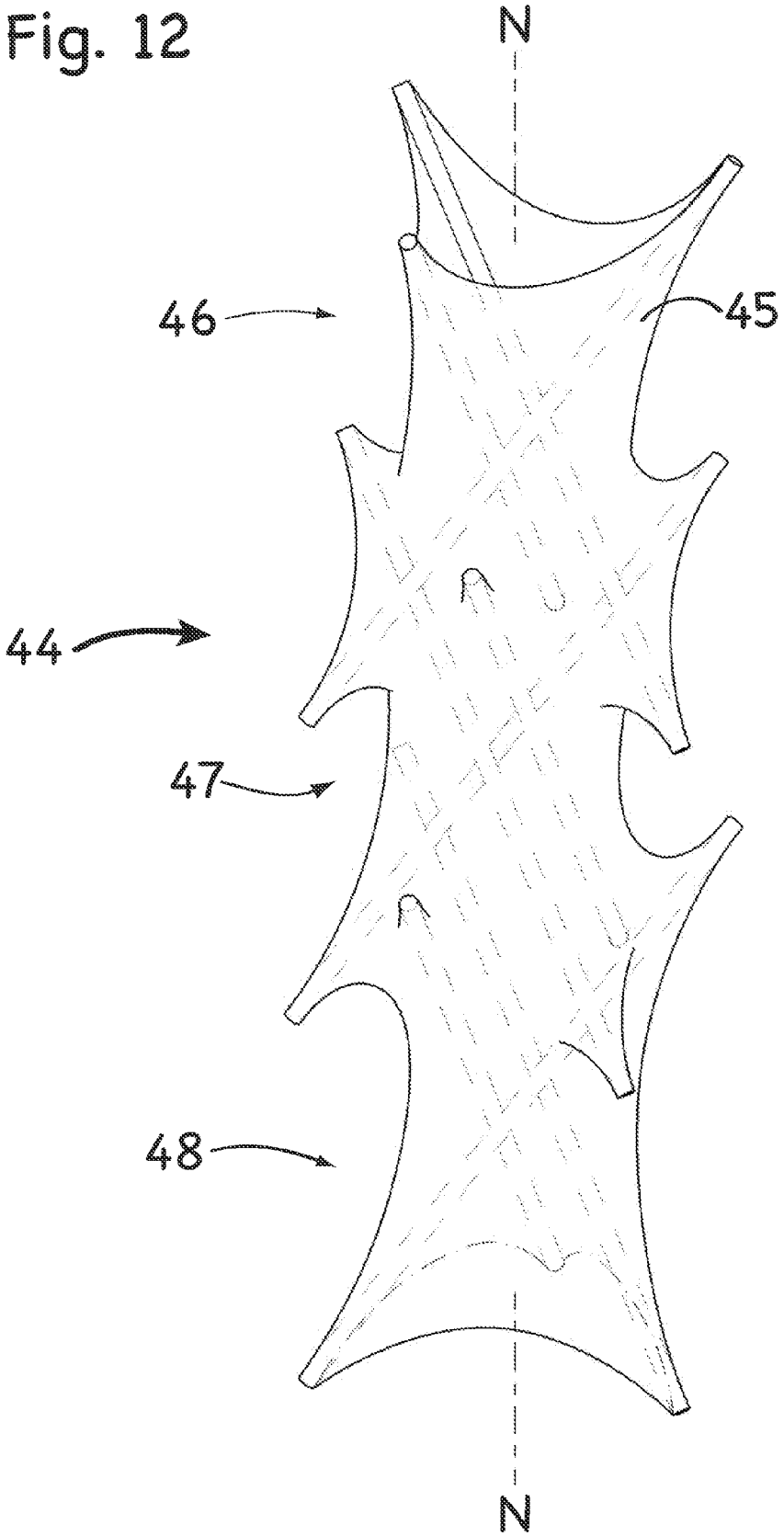
FIG. 12 is a perspective view of a three-tiered structure according to the invention.

Exploiting the invention, the two-tiered structure 27 shown, for example, in FIGS. 10*a*-10*d* can be extended incrementally to the desired length through the addition of units of spirally arranged compression struts overlapping and interweaving one with the other in sequence, accompanied by the corresponding unit extension of the pretensioned, continuous anticlastic membrane 30 along a longitudinal axis. By way of example, FIG. 12 illustrates a three-tiered structure 44 according to the invention composed in this manner, each tier 46, 47 and 48 comprising a unit of three spirally arranged compression struts enclosed in a continuous pretensioned membrane 45. The center compression unit 47 mirrors the arrangement of compression struts in 46 and 48 on either side.

Figure 13:
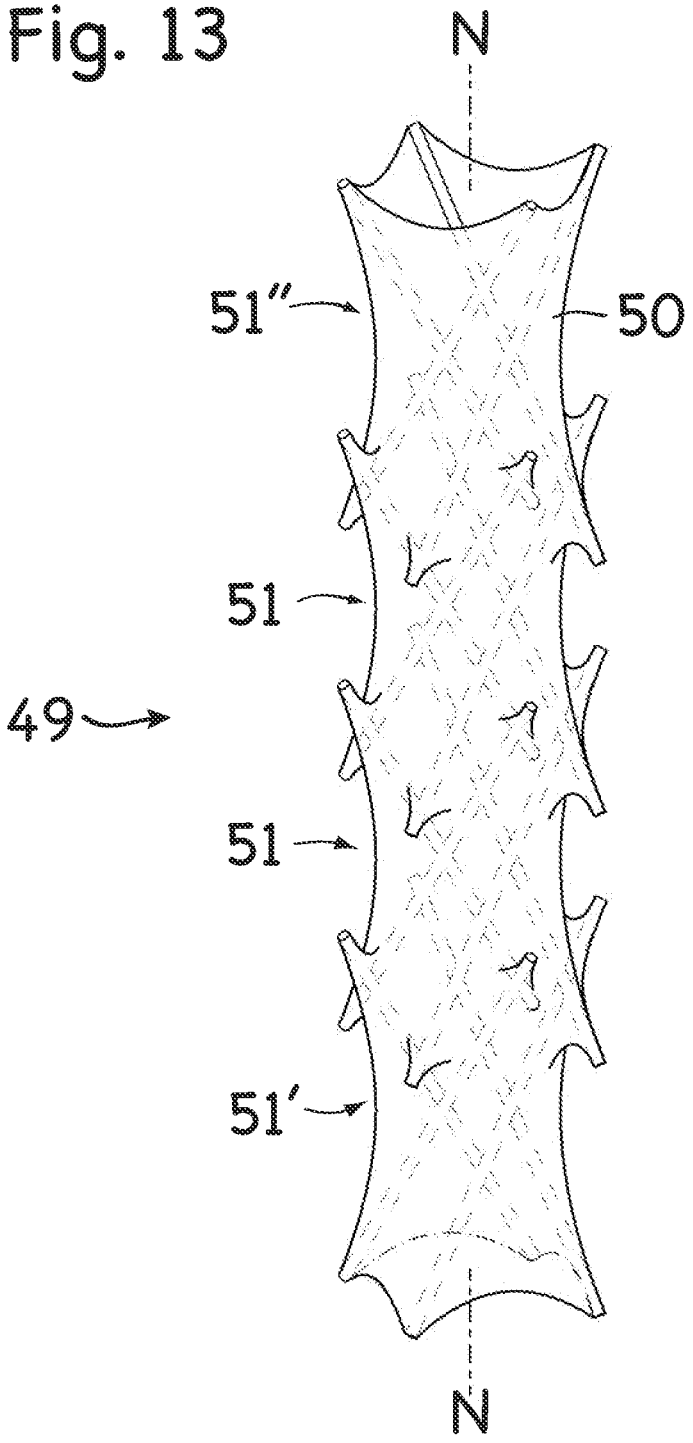
FIG. 13 is a perspective view of a linear structure comprising four tiers of four strut compression units as taught herein.

In a further alternative, FIG. 13 illustrates a four-tiered structure 49 utilizing a four-strut unit 51 of elongate compression members. The units are repeated without mirroring and with only minor variations in the top and bottom tiers 51' and 51" with all tiers enclosed by the pre-stressed membrane 50. It will be noted that, at the open ends of the tubular structures of two tiers or longer, such as the present structure 49, the transverse dimension between strut ends may be greater than in the more constrained, fully enclosed areas where the tiers of compression units overlap. In structure 49, the left-handed rotational tendency of the compression units is not countered by mirrored arrangements of struts spiraling in the opposite direction.

Figure 14:
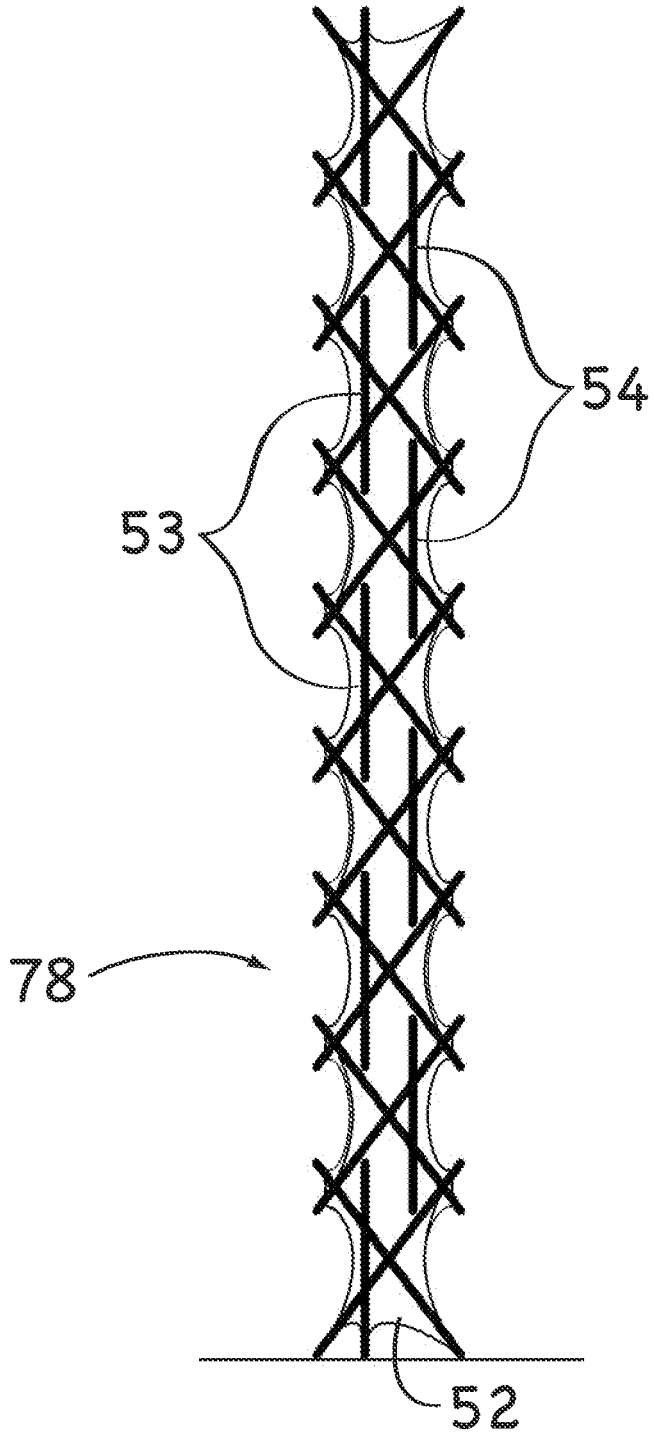
FIG. 14 is a diagrammatic representation of a linear tube of indeterminate length constructed of repeated, mirrored three-strut compression units as disclosed herein.

FIG. 14 depicts in schematic format a free standing column 78 of indeterminate length structured according to the invention comprising a pre-stressed continuous membrane 52 enclosing a repeated overlapping linear arrangement of three compression strut units 53 alternating with mirrored units 54 along a vertical axis. Varying columns 78 and other structures embodying the invention can be accomplished by varying the lengths of the compression struts in the strut units 53 and 54 and altering the form of the pretensioned membrane 52 in a corresponding manner.

Figure 15:
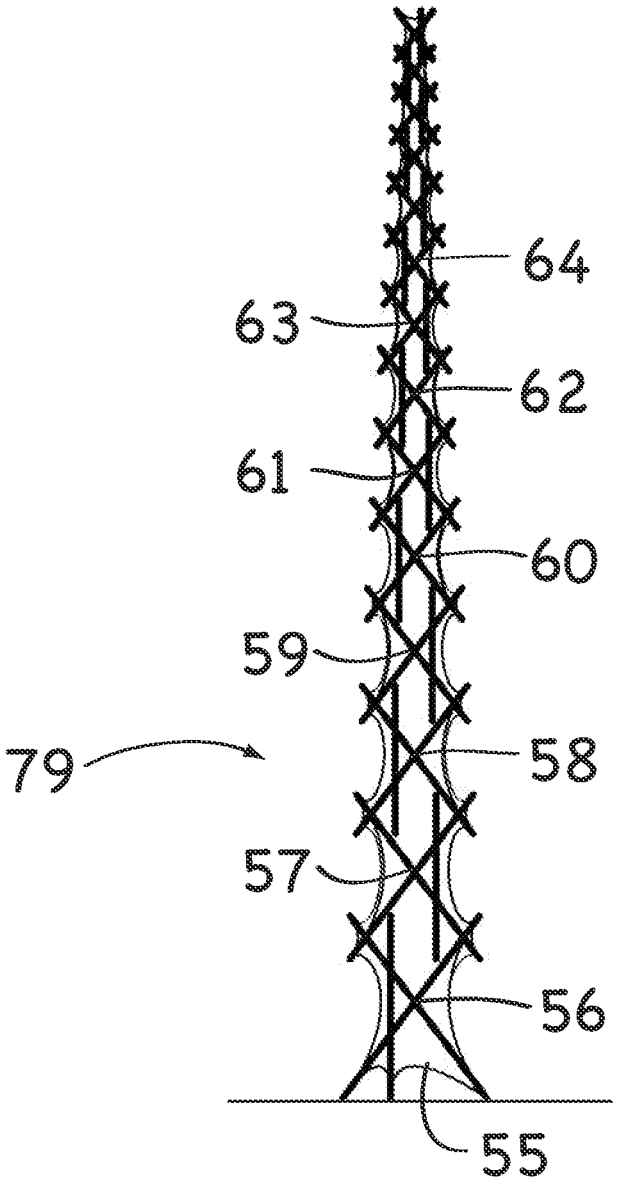
FIG. 15 is a diagrammatic representation of a tapered column exploiting the invention.

For example, FIG. 15 illustrates a tapered column 79 according to the invention resulting from the gradual shortening of the elongate compression members from the bottom to the top of the structure accompanied by corresponding, successive decreases in the circumferences of the continuous membrane 55. In each successive tier, beginning with tier unit 56 and progressing upwardly to 64 and so on, the length of the compression members in each unit 56 to 64 and so on decreases so that each successive unit 57 to 64 has smaller longitudinal and transverse dimensions. Within a limited range, the longitudinal and transverse dimensions of each compression unit 56 to 64 can also vary inversely to each other with changes in the apparent angle between the intermediately crossed members.

Figure 16A:
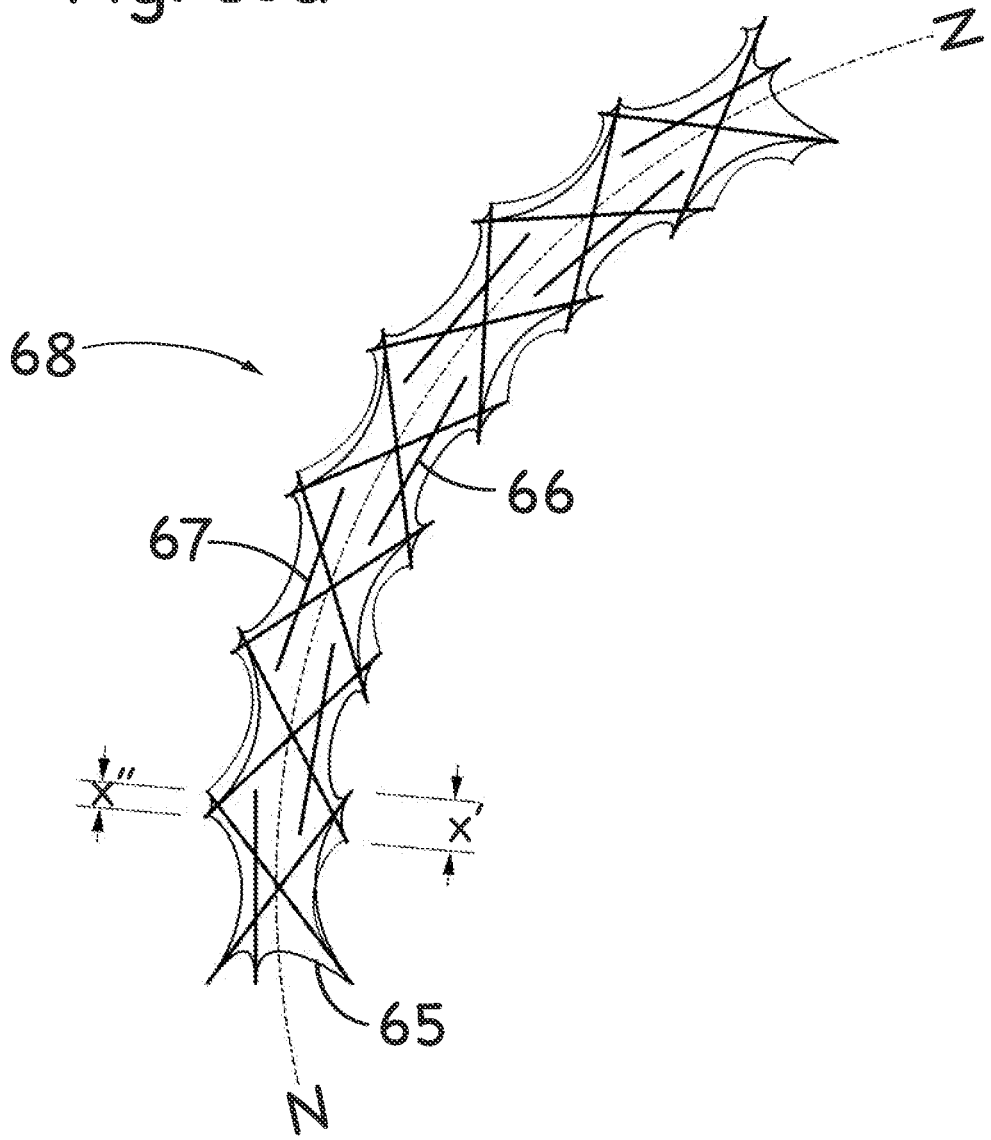
FIG. 16*a* is a diagrammatic representation of a curved structure of indeterminate length constructed of repeated compression units as taught herein.
Figure 16B:
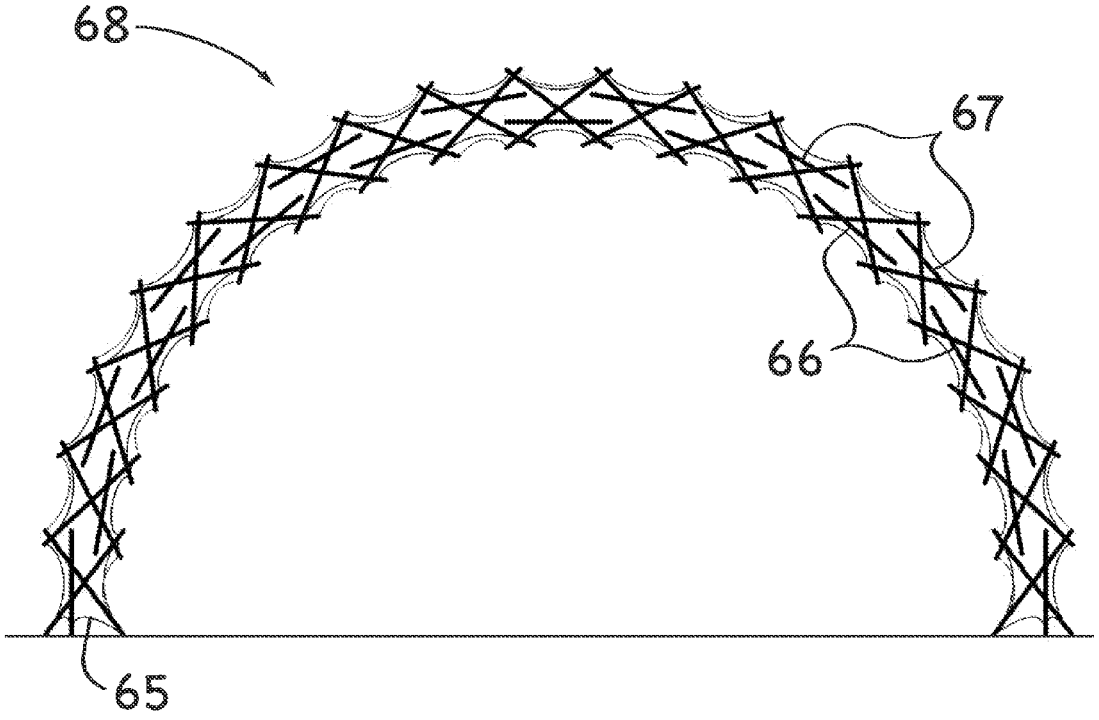
FIG. 16*b* is a diagrammatic representation of an arch created using the curved structure of FIG. 16*a;*
Figure 17:
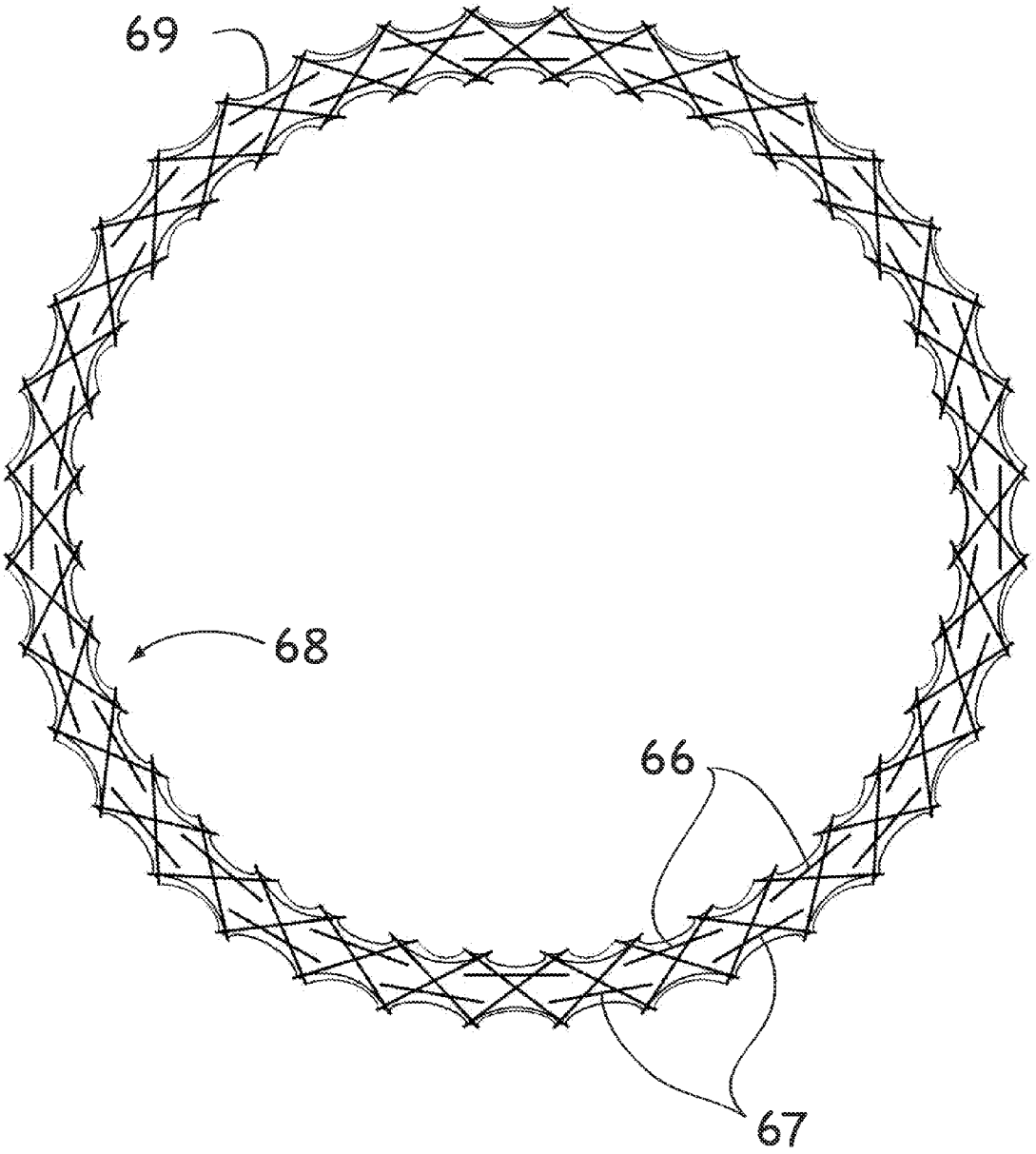
FIG. 17 is a diagrammatic representation of a closed hoop created using the curved structure of FIG. 16*a;*

The present inventor has further realized that arches, hoops, and other curved structures 68 can be created utilizing the invention, including by varying the lengths of the individual compression struts within each compression unit and, additionally or alternatively, by differentially varying the degree of overlap between adjacent compression units so that one side of the tube formed has a greater or lesser length than the other. In one of the many possible examples, FIG. 16*a* schematically illustrates a segment of a curved tubular structure 68 comprising a pre-tensioned membrane 65 encasing mirrored and overlapped three-strut compression units 66 and 67 arrayed along an arching longitudinal axis N. The curvature of the structure 68 results from the difference between the overlap of the adjacent compression units 66 and 67 with the greater overlapping dimension x' on the inside of the curve and the smaller dimension x" on the outside of the curved form. The same arching effect can be obtained by varying the lengths of the compression struts within each unit, and maintaining overlap distances x' and x" as equal. FIG. 16*b* illustrates an arch structure 68 constructed in this fashion utilizing the same compression units 66 and 67 with the same degree of differential overlap between, again enclosed by a continuous pre-tensioned membrane 65. Still further, by employing a membrane 69 that closes with itself, a continuous hoop structure 68 can be formed as in FIG. 17 utilizing the same compression units 66 and 67 with the same degree of differential overlap illustrated in the previous structures 68 of FIG. 16*a* and FIG. 16*b*.

The membrane that forms the tensile component and enclosure of structures according to the invention can be one or more layers of any flexible, permeable, impermeable, or semi-permeable material. The material can be resilient and can be selected based on the application. Chosen membrane materials will preferably withstand tension, not resist compression or bending, and attain stiffness when pretensioned. Among the possible suitable materials are plastic polymers, woven or knit fabrics made of natural or synthetic fibers, woven or welded wire meshes, knit wire meshes, cable nets, or a lattice of elongated tension members joined with flexible connections, designed to evenly distribute forces in tension only and to assume the characteristic continuous and constantly changing anticlastic form of the invention. Of course, multiple layers of different characteristics could be employed, and varied materials could be incorporated in any given layer.

Figure 18:
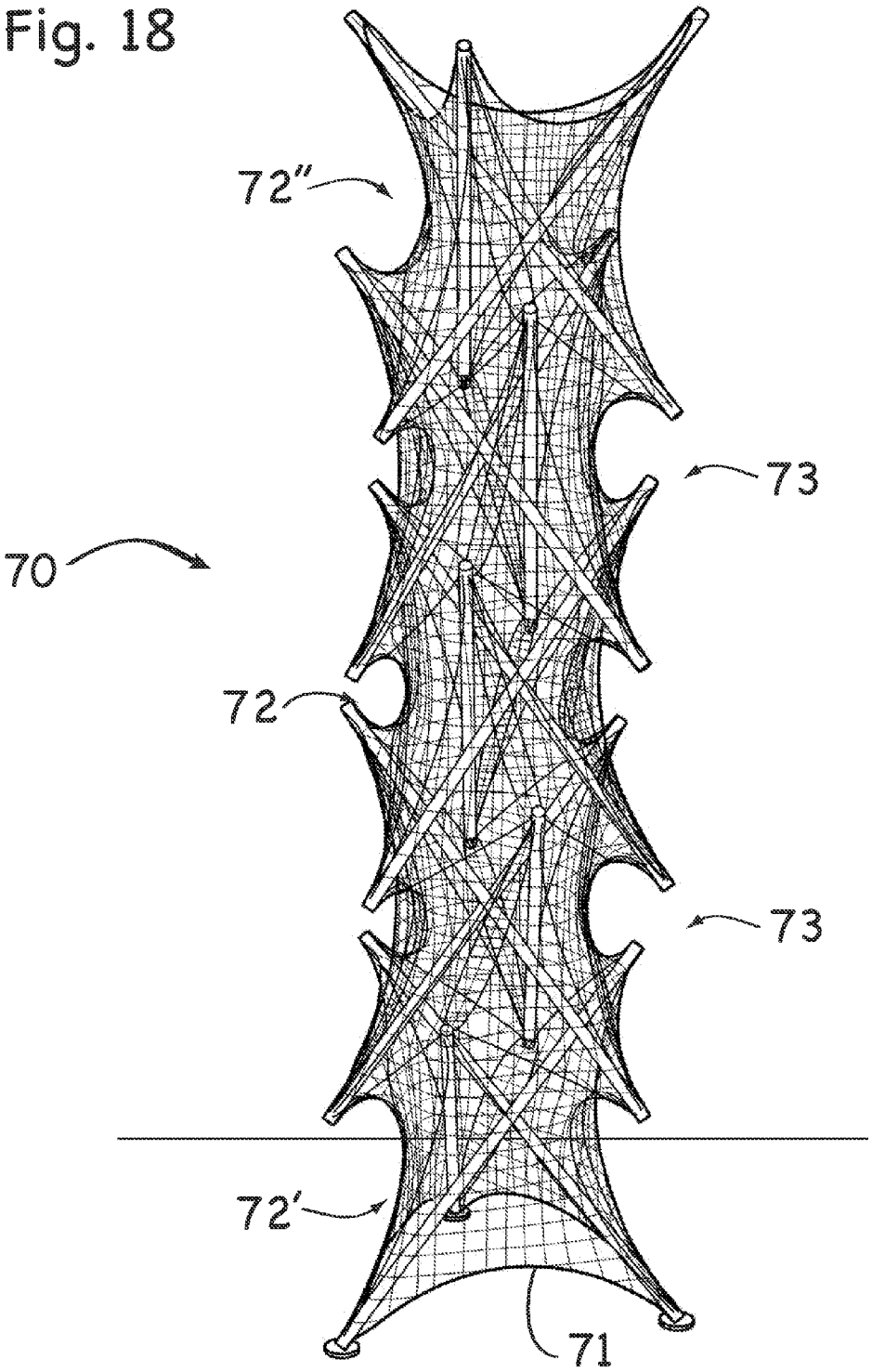
FIG. 18 is a perspective view of a tower constructed utilizing a cable-net as the pre-tensioned membrane.

In an example of the variability of the invention, FIG. 18 illustrates a five-tiered freestanding column 70 constructed according to the invention utilizing a cable-net 71 as a pretensioned membrane enclosing mirrored three-strut compression units 72, 72', 72" and 73. Because forces distributed throughout the membrane 71 concentrate at the ends of discontinuous compression members with enough force to puncture the membrane surface, the membrane can have reinforcements at these connections, or the connections themselves can utilize mastheads or linear supports, such as cable loops, tension rings, ridge cables, reinforced seams or straps to absorb the force of the membrane 71 and directing it to the ends of the compression struts.

Figure 19:
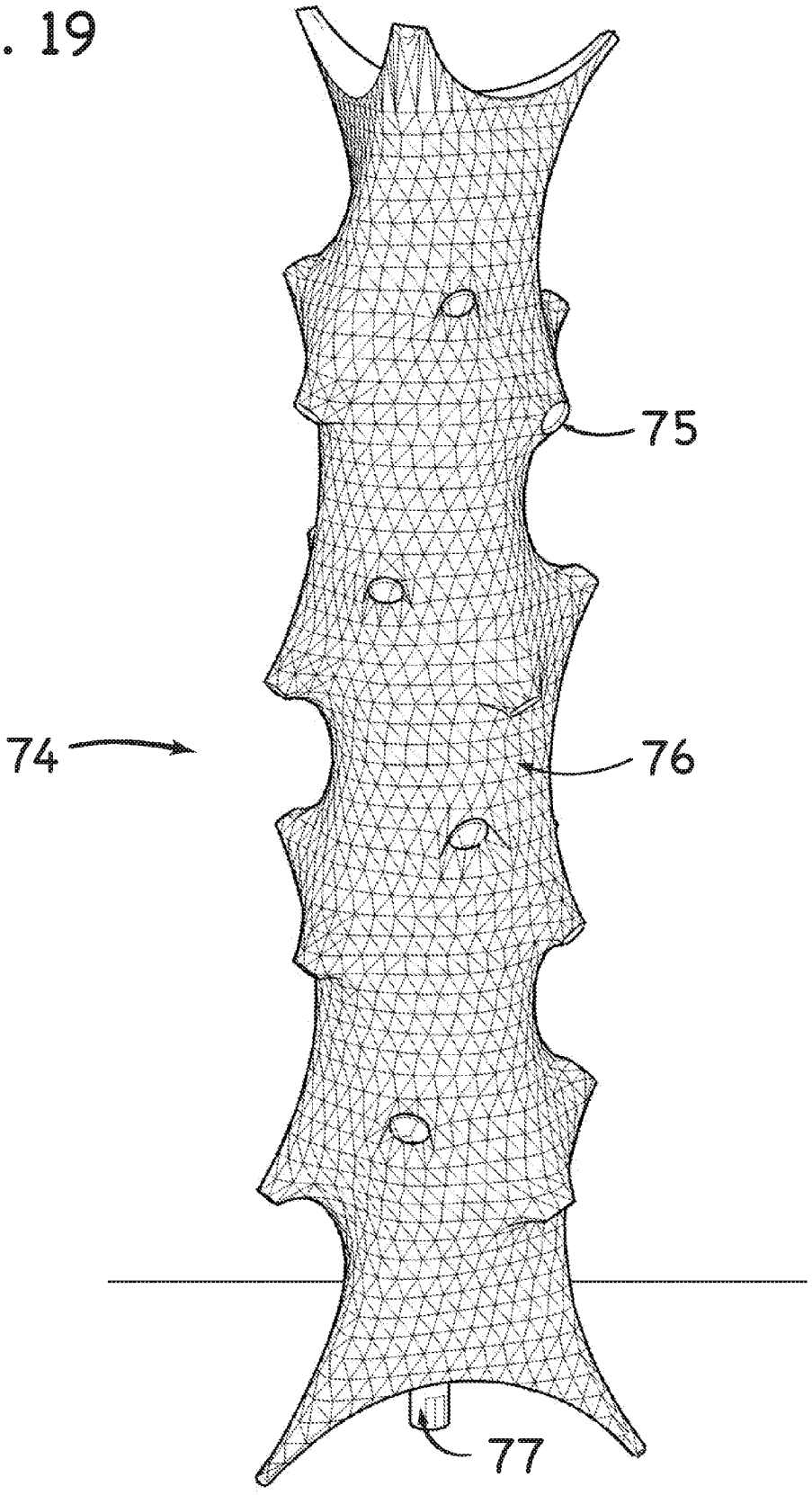
FIG. 19 is a perspective view of a building tower constructed according to the invention.

Still further, FIG. 19 depicts a building tower 74 constructed according to the invention where mast head reinforcements 75 are affixed to each end of the interior compression struts to attach the struts to a structural membrane 76 of articulated triangulated mesh. In this example, an elevator shaft 77 occupies the gap occurring at the centers of the spirally arranged compression members. While other means and methods are contemplated, pre-tensioning of the membrane 76 may be achieved in certain embodiments by effectively lengthening the compression members. This could be carried out, by way of example and not limitation, by the utilization of screw, ratchet or pneumatic jacks, or by stretching the membrane 76 for instance by pulling the membrane 76 toward or into the ends of the compression members. Depending on, among other things, the discontinuous compression members may comprise tubes, rods, bundles, masts or trusses of metal, wood plastic polymers, glass, or hybrid materials designed to carry axial compression without tension or bending.

With certain details of the present invention for continuous tension, discontinuous compression systems and methods disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also all equivalents thereof that might be now known or hereafter discovered.

I claim as deserving the protection of Letters Patent:

1. A tensegrity structure comprising:

a pre-stressed membrane with an inner surface and an outer surface;

a plurality of elongate compression members;

a plurality of tensegrity units disposed in a sequential relationship with each of the plurality of tensegrity units disposed adjacent to at least one other of the plurality of tensegrity units wherein each tensegrity unit is formed by the pre-stressed membrane in combination with at least three of the plurality of elongate compression members wherein the at least three elongate compression members of each tensegrity unit are obliquely disposed in compression within the pre-stressed membrane to establish an open inner volume within the pre-stressed membrane, wherein each compression member has a first end that applies force to the pre-stressed membrane at a first location and a second end that applies force to the pre-stressed membrane at a second location spaced from the first location, wherein the ends of the at least three compression members of each tensegrity unit are not in contact with one another, wherein the at least three compression members of adjacent tensegrity units are not in contact within one another, wherein the tensegrity structure has a longitudinal axis; and wherein the pre-stressed membrane has anticlastic form with a double curvature over the entirety of the inner and outer surfaces of the pre-stressed membrane except at the locations where the ends of the compression members apply force to the pre-stressed membrane.

2. The tensegrity structure of claim 1 wherein the pre-stressed membrane comprises a substantially continuous sheath of resilient material.

3. The tensegrity structure of claim 1 wherein the multiple tensegrity units have the same number of compression members.

4. The tensegrity structure of claim 1 wherein the tensegrity structure has a longitudinal dimension and a lateral dimension and wherein the at least three compression members of adjacent tensegrity units overlap along the longitudinal dimension.

5. The tensegrity structure of claim 1 wherein the pre-stressed membrane forms anticlastic curves between ends of the at least three compression members and wherein the membrane has variable double curvature between ends of the at least three compression members.

6. The tensegrity structure of claim 1 wherein the at least three compression members of adjacent tensegrity units spiral in common orientations.

7. The tensegrity structure of claim 1 wherein the at least three compression members of at least two adjacent tensegrity units spiral in opposite orientations.

8. The tensegrity structure of claim 1 wherein at least one of the tensegrity units has four compression members and wherein the four compression members are crossed between the ends of the four compression members in a spiral in relation to the longitudinal axis.

9. The tensegrity structure of claim 1 wherein the at least three compression members are spaced to establish a gap β about the longitudinal axis.

10. The tensegrity structure of claim 9 wherein the tensegrity structure comprises a building structure and further comprising a column that communicates within the gap β.

11. The tensegrity structure of claim 1 wherein the locations where the first and second ends of the compression members apply force to the pre-stressed membrane comprise nodes and wherein a quadrilateral-shaped pattern is established by groups of four nodes closest to one another wherein each node of the group of four nodes is formed by an end of a different compression member than the other three nodes of the group of four nodes.

12. A tensegrity structure comprising:

a pre-stressed membrane with an inner surface and an outer surface;

a plurality of elongate compression members;

a plurality of tensegrity units disposed in a sequential relationship with each of the plurality of tensegrity units disposed adjacent to at least one other of the plurality of tensegrity units wherein each tensegrity unit is formed by the pre-stressed membrane in combination with at least three of the plurality of elongate compression members, wherein the at least three elongate compression members of each tensegrity unit are obliquely disposed in compression within the pre-stressed membrane to establish an open inner volume within the membrane, wherein each compression member has a first end that applies force to the pre-stressed membrane at a first location and a second end that applies force to the membrane at a second location spaced from the first location, wherein the at least three compression members of adjacent tensegrity units are not in contact within one another, wherein the tensegrity structure has a longitudinal axis; and wherein the pre-stressed membrane has anticlastic form with a double curvature over the entirety of the inner and outer surfaces of the pre-stressed membrane except at the locations where the ends of the compression members apply force to the pre-stressed membrane.

13. The tensegrity structure of claim 12 wherein the ends of the at least three compression members of each tensegrity unit are not in contact with one another.

14. The tensegrity structure of claim 12 wherein the pre-stressed membrane comprises a substantially continuous sheath of resilient material.

15. The tensegrity structure of claim 12 wherein the tensegrity structure has a longitudinal dimension and a lateral dimension and wherein the at least three compression members of adjacent tensegrity units overlap along the longitudinal dimension.

16. The tensegrity structure of claim 12 wherein the pre-stressed membrane forms anticlastic curves between ends of the at least three compression members of each tensegrity unit and wherein the pre-stressed membrane has variable double curvature between ends of the at least three compression members of each tensegrity unit.

17. The tensegrity structure of claim 12 wherein the at least three compression members of each tensegrity unit are spaced to establish a gap β about the longitudinal axis.

18. The tensegrity structure of claim 17 wherein the tensegrity structure comprises a building structure and further comprising a column that communicates within the gap β.

19. The tensegrity structure of claim 12 wherein the tensegrity structure comprises a tapered column formed by a sequential reduction in length of the at least three elongate compression members of adjacent tensegrity units.

20. The tensegrity structure of claim 12 wherein the tensegrity structure comprises a curved structure.

21. The tensegrity structure of claim 20 wherein the curved structure has a curvature at least partially induced by a variation in length of the at least three elongate compression members within each tensegrity unit.

22. The tensegrity structure of claim 20 wherein the curved structure has a curvature at least partially induced by a variation in overlap between adjacent tensegrity units.

23. The tensegrity structure of claim 12 wherein the locations where the first and second ends of the compression members apply force to the pre-stressed membrane comprise nodes and wherein a quadrilateral-shaped pattern is established by groups of four nodes closest to one another wherein each node of the group of four nodes is formed by an end of a different compression member than the other three nodes of the group of four nodes.

* * * * *